United States Patent [19]

Schultz et al.

[11] Patent Number: 5,058,674

[45] Date of Patent: Oct. 22, 1991

[54] WELLBORE FLUID SAMPLER AND METHOD

[75] Inventors: Roger L. Schultz, Plano; Kevin R. Manke, Flower Mound; H. Kent Beck, Copper Canyon, all of Tex.

[73] Assignee: Halliburton Company, Duncan, Okla.

[21] Appl. No.: 602,840

[22] Filed: Oct. 24, 1990

[51] Int. Cl.[5] ..... E21B 49/08

[52] U.S. Cl. ..... 166/264; 166/53; 166/64; 166/65.1; 166/164; 166/169; 73/864.62; 73/864.64

[58] Field of Search ..... 166/264, 64, 162, 163, 166/164, 169, 65.1, 53, 317; 175/59, 233; 73/863.71, 863.72, 864.63, 864.62, 864.64

[56] References Cited

U.S. PATENT DOCUMENTS

| | | | |
|---|---|---|---|
| 2,557,925 | 6/1951 | Stokes | 175/233 |
| 2,862,561 | 12/1958 | Teubner | 166/165 |
| 3,095,930 | 7/1963 | Kisling, III | 166/163 |
| 4,372,382 | 2/1983 | Rooney et al. | 166/264 |
| 4,417,622 | 11/1983 | Hyde | 166/264 |
| 4,422,506 | 12/1983 | Beck | 166/264 X |
| 4,502,537 | 3/1985 | Carter, Jr. | 166/162 |
| 4,579,174 | 4/1986 | Barrington | 166/264 X |
| 4,597,439 | 7/1986 | Meek | 166/264 X |
| 4,665,983 | 5/1987 | Ringgenberg | 166/250 |
| 4,766,955 | 8/1988 | Petermann | 166/167 |
| 4,787,447 | 11/1988 | Christensen | 166/169 |
| 4,903,765 | 2/1990 | Zunkel | 166/162 |

*Primary Examiner*—Stephen J. Novosad
*Attorney, Agent, or Firm*—C. Dean Domingue; L. Wayne Beavers

[57] ABSTRACT

A well fluid sampling apparatus provides a time delay after actuation of the tool and before a sample is taken. The tool is operated by well pressure acting on a piston. The piston is initially hydraulically blocked so that it cannot move. The time delay is provided after the piston begins moving. Additional time delay devices can optionally be included.

42 Claims, 17 Drawing Sheets

WELLBORE FLUID SAMPLER AND METHOD

BACKGROUND OF THE INVENTION

1. Field of the Invention

The present invention relates generally to a fluid sampling tool which uses well pressure in an oil or gas well to move a valve to allow a well fluid sample to be taken. More particularly, but not by way of limitation, the invention relates to various means for controlling the operation of such a sampling tool.

2. Description of the Prior Art

In general, to obtain a sample, a fluid sampling tool is first lowered into the well on a tubing string or a wire line or a slick line. When the tool is at the desired depth, a port (one or more openings) defined in the tool is opened. The port may open in response to pressure exerted through the well fluid or in response to an electrical actuation signal from the surface. The open port admits well fluid into a sample retaining chamber within the tool. The port is thereafter closed, the tool is withdrawn from the well, and the sample is taken from the chamber for analysis.

Zunkel U.S. Pat. No. 4,903,765, and assigned to the assignee of the present invention, shows a recent improvement in such fluid sampling tools, wherein the fluid sampling tool is constructed to have a time delay which starts when a valve of the tool first starts to move in response to pressure from the well. This time delay provides various advantages. In one instance, the time delay allows undesired fluids such as drilling fluids to bypass the sampling tool before the valve communicates a sample port with a sample chamber and a sample of the well fluid is taken. In another instance, the time delay can reduce the dependency on accurate pressure readings and shear pins which control the opening of the valve. For example, when a maximum bottom hole pressure is measured or otherwise anticipated, shear pins providing a holding force of something less than this maximum pressure, but one which will clearly be encountered somewhere downhole despite a lack of assurance as to precisely where it will be, can be used so that the pins will break at some location above the bottom of the well. The time delay, designed with a suitable tolerance to assure reaching bottom before its expiration, is then used to allow the tool to be run on down to the well bottom, where it will ultimately automatically open.

The present invention provides various improvements upon a delayed opening fluid sampler of the type generally shown in Zunkel U.S. Pat. No. 4,903,765. The improvements relate generally to various means for controlling the actuation of the valve which controls flow of the sample fluid to the sample chamber.

SUMMARY OF THE INVENTION

A fluid sampling apparatus is provided which includes a body having a first chamber, a second chamber, a third chamber and a sample port defined therein, said sample port being communicated with an outside zone outside the body. Impedance means is disposed in the body between the second and third chambers for impeding fluid flow from the second chamber to the third chamber. Sample valve means is disposed in the body between the sample port and the first chamber for being moved relative to the body in response to outside pressure from said outside zone acting on said sample valve means, and for communicating said sample port with the first chamber only after a predetermined first time delay after said outside pressure begins moving said sample valve means. The body, impedance means, and sample valve means just described are common to the prior art sampler shown in the Zunkel U.S. Pat. No. 4,903,765.

The fluid sampler of the present invention is improved through the addition to the structure just described of a selective blocking means, disposed in said body between said second and third chambers, for initially isolating said second chamber from said third chamber to hydraulically block the sample valve means against movement in response to said outside pressure.

In one embodiment this selective blocking means takes the form of a rupture disk. In other embodiments, this selective blocking means takes the form of a blocking valve being movable between a closed and an open position.

Those embodiments using a blocking valve may also include a timer means for providing a second predetermined time delay prior to the time at which the blocking valve is moved to an open position to allow the sample valve means to begin moving. The timer means may either be a hydraulic timer or an electrical timer. The preferred hydraulic timer includes a restricted orifice and a spring biased piston means for pushing a predetermined volume of fluid through the restricted orifice.

Another aspect of the present invention is the provision of a disabling means for disabling an apparatus such as the fluid sampling apparatus described above when fluid pressure in the well outside the apparatus exceeds a predetermined level. Such a disabling means prevents the trapping of a fluid sample within the tool at pressures in excess of the predetermined level. This is a safety feature which can be utilized to prevent trapping a sample having such a high pressure that it cannot be safely handled once the tool is removed from the well.

Yet another aspect of the present invention involves the provision of a separate sample port and power port in the body. The sample port communicates the well exterior of the body to the sample chamber when the sampling apparatus is actuated. The power port separately communicates the well with the power piston which actuates the sampling valve.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

In FIG. 3 the apparatus is shown in its initial position prior to the taking of the sample. In FIG. 4 the apparatus is shown in an intermediate position during the time in which the sample chamber is filling with a well sample. FIG. 5 illustrates the apparatus in a final position in which the sample is sealed in place within the sample chamber.

DETAILED DESCRIPTION OF THE PREFERRED EMBODIMENTS

Figure 1:
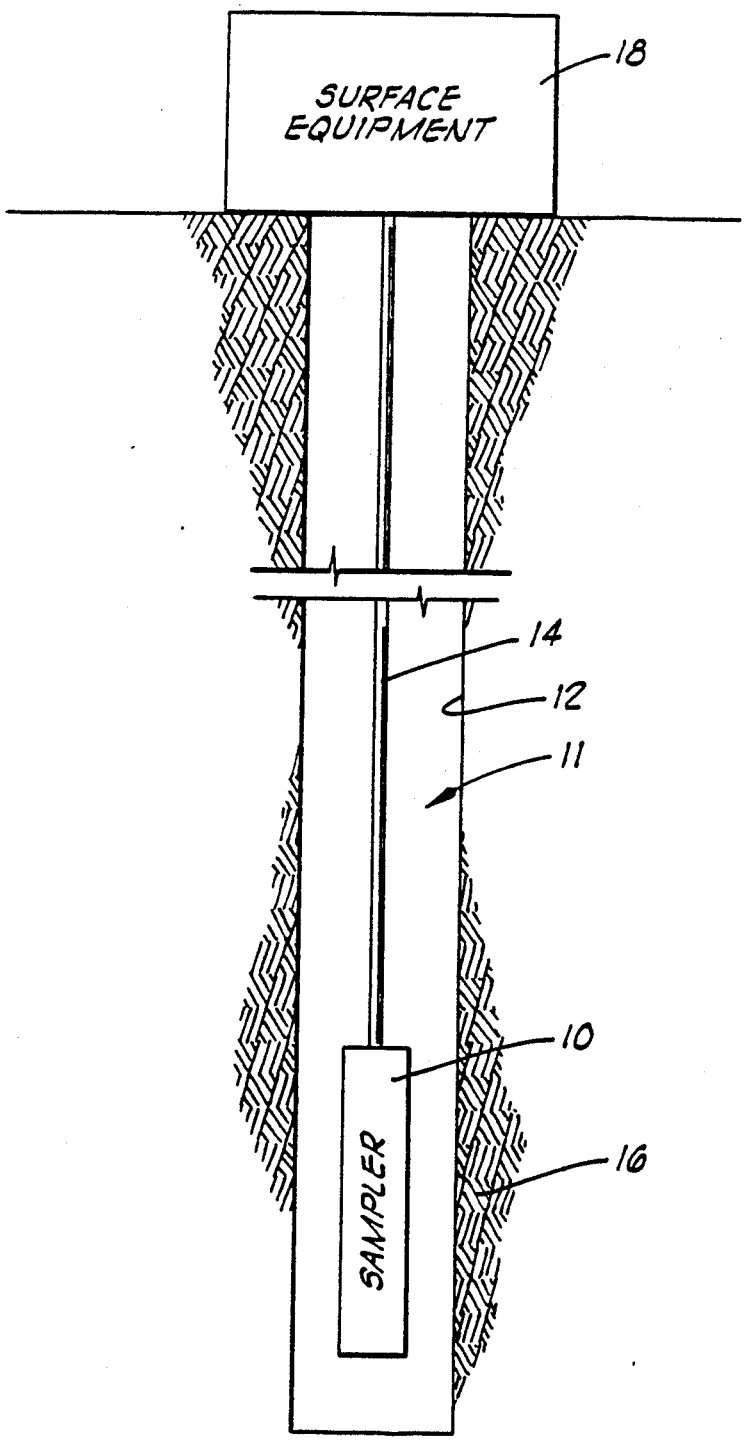
FIG. 1 is a schematic block diagram depicting the sampler apparatus of the present invention in place within a well which is to be sampled.

Referring now to FIG. 1, a fluid sampling apparatus 10 is shown disposed in an oil or gas well 11 defined by a bore 12 which is typically lined with casing (not shown). The fluid sampling apparatus 10 is lowered and raised relative to the bore 12 on a slick line 14. It will be appreciated that the apparatus 10 can also be run on a tubing string, on a wire line, or below a packer as is well known to those skilled in the art. The well bore 12 is shown as intersecting a subsurface formation 16, the flow from which is to be sampled. Formation fluids from the formation 16 flow into the well 11 and are sampled by the fluid sampling apparatus 10.

The sampling apparatus 10 is lowered from and controlled by various surface equipment schematically illustrated at 18, which is located at the surface of the well.

Another particular environment in which the present invention can be used is in a large sample chamber of a perforate/test sampler tool which is placed in the well.

The Embodiment of FIGS. 2–5

Referring now to FIGS. 2A–2D, an elevation sectioned view is thereshown of a first embodiment of the fluid sampling apparatus of the present invention which is generally designated by the numeral 10 corresponding to the apparatus 10 shown schematically in FIG. 1.

Fluid sampling apparatus 10 includes a body or housing 18 made up of a plurality of segments which are connected together by threads or other suitable means. O-ring seals are located adjacent each of the threaded connections. The body 18 includes an upper end coupling member 20, an upper coupling adapter 22, a sample chamber section 24, a valve housing section 26, a drain nipple 28, a lower coupling adapter 30, and a lower end coupling 32.

The body 18 has first, second and third chambers generally designated by the numerals 34, 36, and 38, respectively, defined therein. The first chamber 34 is also referred to as a sample chamber 34. The second chamber 36 is also referred to as an oil chamber 36. The third chamber 38 is also referred to as an air chamber or dump chamber 38.

The valve housing section 26 of body 18 has a sample port 40 defined therein which is communicated with the well 11 outside the apparatus 10, which may generally be referred to as an outside zone 11 outside the body 18.

Figure 2A:
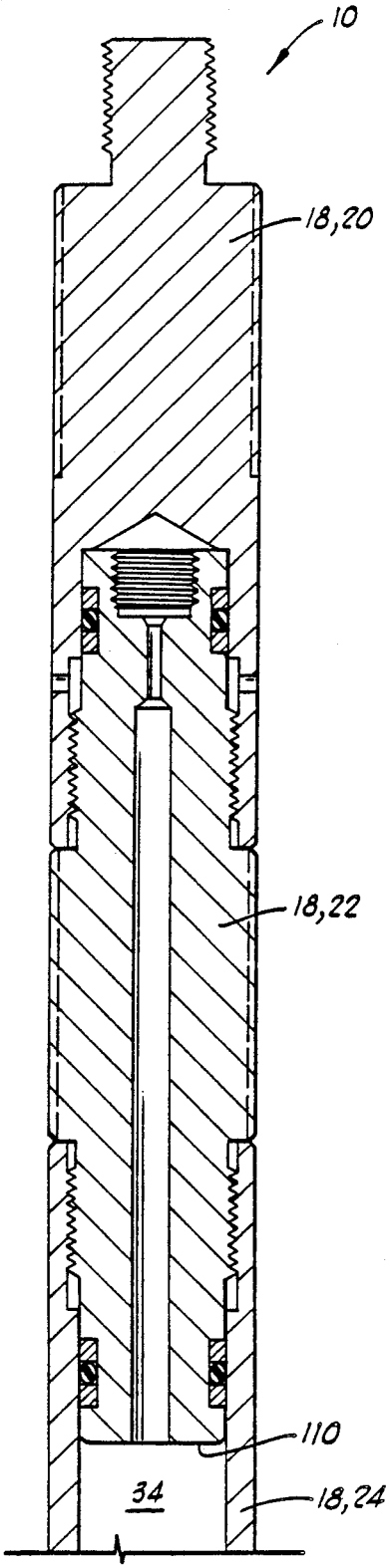
FIGS. 2A–2D comprise an elevation sectioned view of a first embodiment of the fluid sampling apparatus of the present invention. In this embodiment a rupture disk is used to initially hydraulically block the sample valve.
Figure 2B:
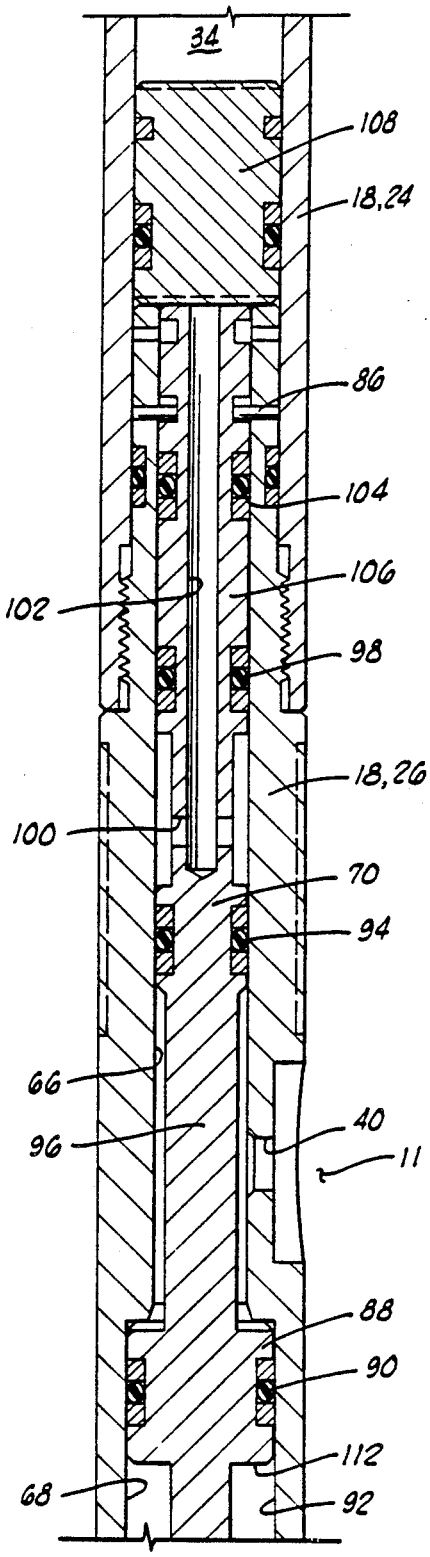
Figure 2C:
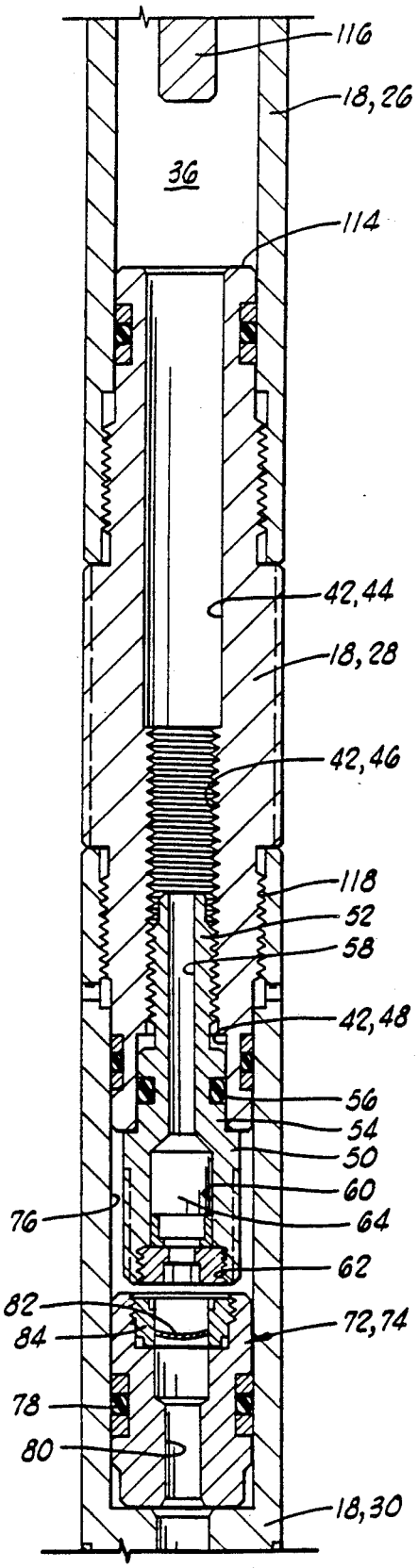
Figure 2D:
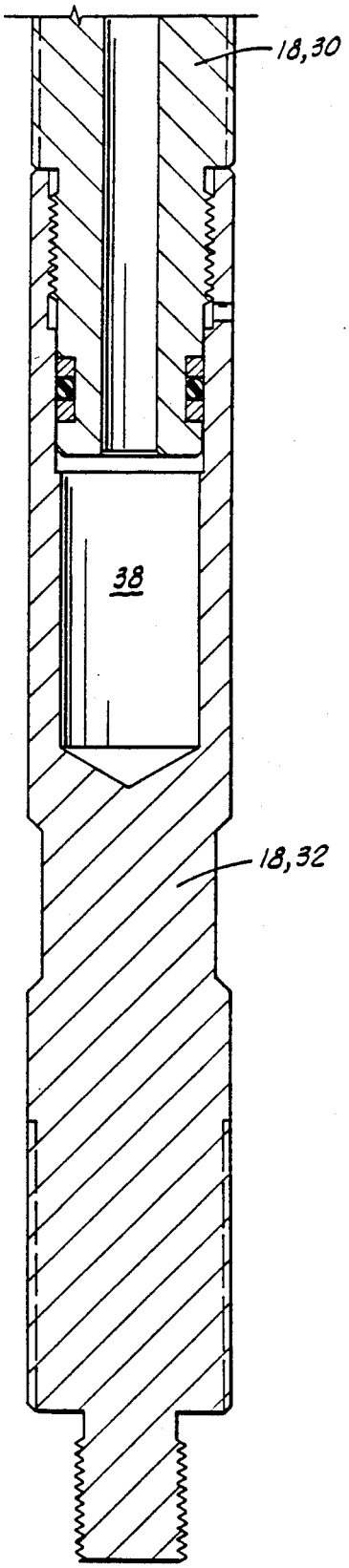

Referring to FIG. 2C, the drain nipple 28 has an axial passageway 42 defined lengthwise therethrough which is made up of an upper smooth bore portion 44, and intermediate threaded bore portion 46, and a lower smooth counterbore portion 48.

A metering cartridge 50 has an upwardly extending portion 52 threadedly connected to the intermediate threaded bore portion 46 of drain nipple 28. The metering cartridge 50 has an enlarged diameter intermediate portion 54 closely received in counterbore 48 with an O-ring seal 56 provided therebetween. Metering cartridge 50 has a metering cartridge passageway 58 defined therethrough which includes first and second counterbores 60 and 62 adjacent its lower end.

In the lower end of metering cartridge 50, a metering orifice means 64 is provided, which preferably is a device such as a Visco-Jet element of a type well known to the art. The orifice means 64 provides an impedance means 64 disposed in the body 18 between the second and third chambers 36 and 38 for impeding flow of hydraulic fluid from the oil chamber 36 through the orifice means 64 to the air chamber 38.

The valve housing section 26 of body 18 has a valve bore 66 defined therethrough including a counterbore 68 at its lower end. A sliding spool type sample valve means 70 is disposed in the bore 66 of valve housing section 26 of body 18 between the sample port 40 and the sample chamber 34. The sample valve means 70 provides a means for being moved relative to the body 18 in response to outside pressure from the outside well zone 11 acting on the sample valve means 70. The sample valve means 70 also provides a means for communicating the sample port 40 with the sample chamber 34 after a predetermined first time delay after the pressure from outside well zone 11 begins moving the sample valve means 70.

A selective blocking means generally designated by the numeral 72 is disposed in the body 18 between the oil chamber 36 and the air chamber 38 for initially isolating the oil chamber 36 from the air chamber 38 to hydraulically block the sample valve means 70 against movement in response to pressure in the well 11 communicated through port 40.

Selective blocking means 72 includes a cylindrical cartridge 74 closely received within a bore 76 of lower coupling adapter 30 with an O-ring seal 78 being provided therebetween. Cartridge 74 has a cartridge passage 80 disposed therethrough, and has a rupture disk 82 in place initially blocking cartridge passage 80. The rupture disk 82 is contained in a threaded insert 84 which is threadedly received in the upper end of cartridge 74.

The rupture disk 82 initially isolates the oil chamber 36 from the air chamber 38. When a pressure differential between the outside well zone 11 and the air chamber 38 reaches a predetermined level at which the rupture disk 82 is designed to rupture, the disk 82 will rupture thus allowing oil from oil chamber 3 to begin metering through the orifice means 64 into air chamber 38 thus permitting the sample valve 70 to begin moving within the body 18.

As seen near the upper end of FIG. 2B, shear pins 86 may optionally be used with the valve means 70 to prevent premature movement of the valve means 70.

The valve means 70 includes an enlarged piston portion 88 having a seal 90 slidably received within a lower bore 92 of valve housing section 26 below the port 40. Valve means 70 carries an upper sliding seal 94 which is received within the bore 66 initially above port 40.

Well pressure from the well 11 acting through port 40 initially acts downward on the valve means 70 on the differential area between seals 94 and 90. This pressure is transmitted to the oil in oil chamber 36, and acts against the rupture disk 82 until such time as the rupture disk 82 ruptures. Then, the downward acting force on valve means 70 will shear the shear pins 86 and the valve means 70 will begin moving downward thus slowly forcing the oil from oil chamber 36 through the orifice means 64 into the air chamber 38.

The portion 96 of valve means 70 between seals 90 and 94 can be described as a first closure means 96 for maintaining the sample port 40 sealed from the sample chamber 34 as the valve means 70 moves relative to the sample port 40 during a predetermined time delay. This time delay is determined by several factors, including the viscosity of the oil in oil chamber 36, the nature of the flow restriction provided by orifice means 64, and the physical distance through which the valve means 70 must move before the upper seal 94 passes the sample port 40.

Valve means 70 carries another seal 98 spaced a distance above the seal 94. Located between seals 94 and 98 is a fill port 100 communicated with a sample fill passageway 102 communicated with the upper end of valve means 70. The fill port 100 and passageway 102 located between seals 94 and 98 can be described as an open means connected to the first closure means 96 for providing a fluid conducting passageway between the sample port 40 and the sample chamber 34 after the predetermined time delay provided by the time necessary for the seal 94 to move past sample port 40.

Finally, the valve means 70 carries a fourth seal 104 above the seal 98. An intermediate portion 106 of the valve means 70 between seals 98 and 104 can be described as a second closure means 106 connected to the open means 100, 102 for sealing the sample chamber 34 from the sample port 40 after the seal 104 of the open means has moved past the sample port 40 to a final closed position of the valve means 70 wherein a fluid sample is sealed in the sample chamber 34.

It is noted that a floating piston 108 is disposed in the sample chamber 34. As the sample fluid flows into sample chamber 34 the piston 108 will move upward providing a barrier between the trapped sample and air previously contained in the sample chamber 34. The floating piston 108 will ultimately abut a lower end 110 of upper coupling adapter 22 when the sample chamber 34 has been entirely filled with well fluid.

The valve means 70 will come to rest with the lower shoulder 112 of enlarged diameter piston 88 abutting the upper end 114 of drain nipple 28. A lower valve extension 116 protruding downward from piston 88 will then be located within the upper smooth bore portion 44 of the drain nipple 28. The internal pressure of the sample trapped within sample chamber 34 will continue to act downwardly on valve means 70 to hold it in position abutting drain nipple 28 thus maintaining the sample sealed within the sample chamber 34 as the apparatus 10 is later withdrawn from the well 11.

After the apparatus 10 has been removed from the well 11 and transported to the laboratory, the fluid sample can be removed from sample chamber 36 in the following manner. The lower coupling adapter 30 is removed from drain nipple 28 by disconnecting the threaded connection 118 therebetween. Then the metering cartridge 50 is also disconnected from the drain nipple 28. An appropriate receptacle (not shown) is connected to the sample port 40. A drain control device (not shown) is then connected to threaded connection 118 and is engaged with the extension 116 to push the valve means 70 upwards until the seal 98 moves up past valve port 40 thus allowing the sample to escape through the passage 102, 100 and through port 40 and to the receptacle.

Figure 3:
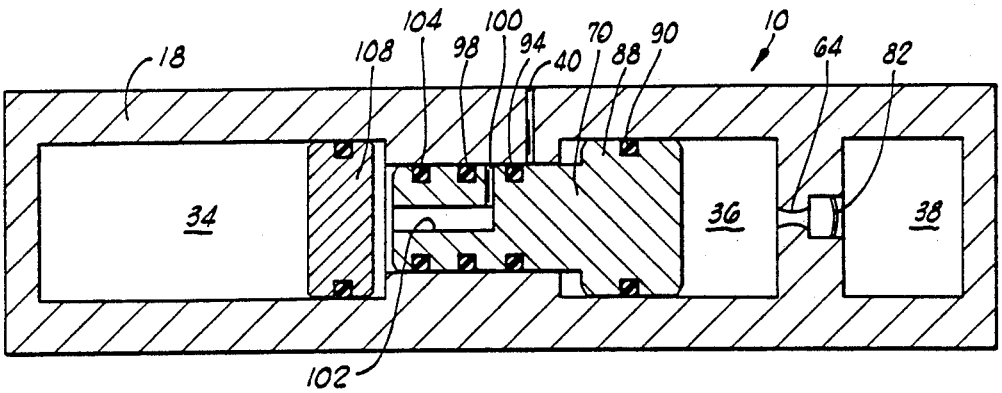
FIGS. 3, 4 and 5 schematically illustrate sequential steps in the operation of the apparatus of FIGS. 2A–2D.
Figure 4:
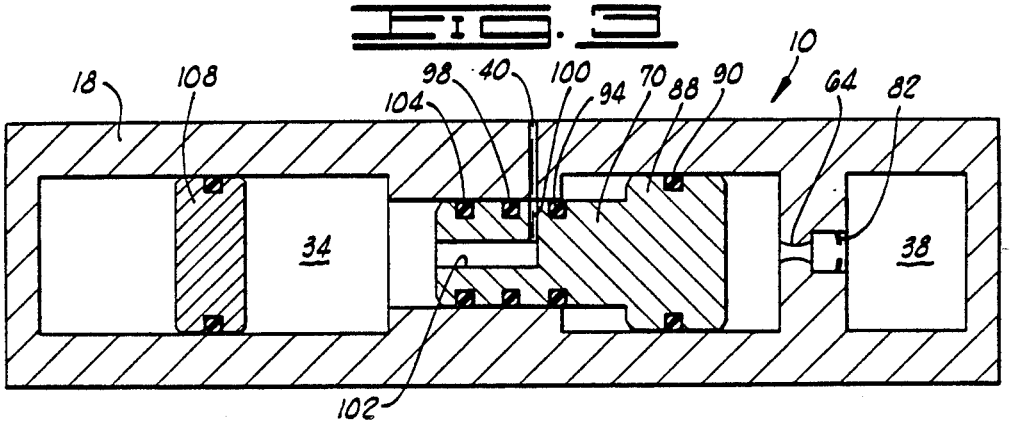
Figure 5:
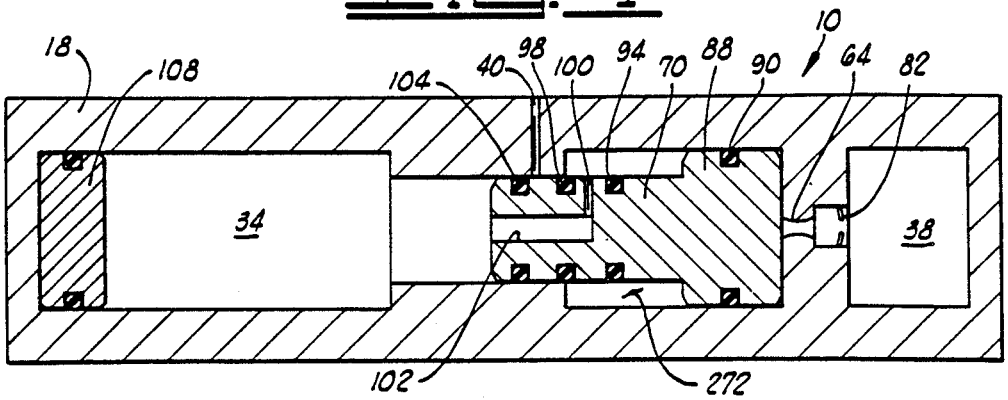

The operation of the sampling apparatus 10 of FIGS. 2A–2B is schematically illustrated in FIGS. 3–5.

In FIG. 3, the apparatus 10 is shown in its initial position corresponding to that shown in greater detail in FIGS. 2A–2D. The seals 94 and 90 of valve means 70 are on either side of the sample port 40 thus blocking the sample port 40 and isolating it from the sample chamber 34.

In FIG. 4, the rupture disk 82 has ruptured thus allowing the sample valve means 70 to begin moving from left to right until such time as the sample port 40 is located between seals 94 and 98 thus allowing a sample to flow through the port 100 and passageway 102 of valve means 70 to begin filling the sample chamber 34. The floating piston 108 moves upward within the sample chamber 34 as it fills with well fluid.

In FIG. 5, the sample chamber 34 has completely filled with well fluid and the valve means 70 has moved to its final position wherein the sample port 40 is located between seals 98 and 104 thus sealing the sample within sample chamber 34.

The Embodiment of FIGS. 6 and 7

FIGS. 6 and 7 illustrate another embodiment of the fluid sampling apparatus of the present invention, which embodiment is generally designated by the numeral 120. The apparatus 120 is shown in FIGS. 6A–6H in its initial position, and is shown in FIGS. 7A–7H in its final position after a sample has been trapped therein.

The fluid sampling apparatus 120 includes a body or housing 122. The body 122 is made up of a number of individual components threadedly connected together with suitable seals provided therebetween. From top to bottom, the components of the body 122 include upper end coupling 124, upper coupling adapter 126, upper oil chamber housing 128, intermediate adapter 130, sample chamber section 132, valve housing section 134, drain nipple 136, blocking means housing section 138, spring housing section 140, intermediate coupling 142, lower adapter 144, and lower end coupling 146.

Defined in the body 122 are a sample chamber 148, an oil chamber 150, and an air chamber or dump chamber 152 which function analogously to the chambers 34, 36 and 38, respectively, previously described with regard to FIGS. 2–5.

A metering cartridge 154 is threadedly connected to drain nipple 136 at threaded connection 156 with an O-ring seal 158 being provided therebetween. Metering cartridge 154 carries an orifice means 160 like the orifice means 64 previously described. The orifice means 160 provides an impedance means 160 disposed in the body 122 between oil chamber 150 and air chamber 152 for impeding flow of hydraulic fluid which fills oil chamber 150 from the oil chamber 150 to the air chamber 152.

The valve housing section 134 of body 122 has both a sample port 162 and a separate power port 164 defined therein.

A sliding spool type sample valve means 166 is slidably received within a bore 168 of the valve housing section 134. The valve means 166 has been modified in several aspects as compared to the valve means 70 of the embodiment shown in FIGS. 2A–2D. A seal 170 has been added below the sample port 162 when the valve means 166 is in its initial position, thus isolating the sample port 162 from enlarged diameter piston 172 and its piston seal 174. Fluid pressure from the well 11 to move the piston 172 is provided through the separate power port 164.

The upper portions of valve means 166 above the sample port 162 are substantially identical to the analogous portions of the valve means 70 previously described and include seals 176, 178 and 180 along with fill port 182 and fill passage 184.

A selective blocking means or selective closure means 186 is disposed in the body 122 between the oil chamber 150 and air chamber 152 for initially isolating the oil chamber 150 from the air chamber 152 to hydraulically block the sample valve means 166 against movement in response to pressure in the well 11. The blocking means 186 is further characterized as a means for communicating the oil chamber 148 and the dump chamber 130 independently of a value of a pressure differential between the well 11 and the dump chamber 150, thus permitting well fluid pressure to move the sample valve means 166. The selective blocking means 186 includes a blocking valve 188 shown in FIG. 6E in its closed position wherein the oil chamber 150 and air chamber 152 are isolated from each other, and shown in FIG. 7E in its open position wherein the oil chamber 150 and air chamber 152 are communicated with each other.

The blocking valve 188 is a sliding sleeve type valve which includes a cylindrical valve body 190 received within a bore 192 of blocking means housing section 138 with an O-ring seal 193 being provided therebetween. Valve body 190 includes a downwardly extending neck portion 194. A valve passage 196 extends through the valve body 190 to a radially extending valve port 198 which communicates with the outer surface of the neck portion 194. The blocking valve 188 also includes a sliding sleeve 200. A pair of O-ring seals 202 and 204 are carried by the neck portion 194 on opposite sides of valve port 198, so that when the sleeve 200 is in the closed position shown in FIG. 6E the valve port 198 is sealingly blocked by sleeve 200.

The fluid sampling apparatus 120 includes a timer means generally designated by the numeral 206 which is associated with and may be considered a part of the selective blocking means 186, for providing a predetermined time delay prior to a time at which the blocking valve 188 moves to its open position to communicate the oil chamber 150 and air chamber 152. The timer means 206 illustrated in FIGS. 6A–6H is a hydraulic timer means including a timing piston 208 biased by mechanical spring 210 against a volume of oil trapped in a lower oil chamber 212. Timing piston 208 carries an O-ring seal 209 closely received within a bore 211 of lower oil chamber 212. The spring biased piston 208 pushes a predetermined volume of oil contained in lower oil chamber 212 through a Visco Jet type of fluid flow restriction or restricted orifice 214 into a lower air chamber or dump chamber 216. The amount of time delay provided by the timer means 206 is dependent upon the volume of oil in oil chamber 212, the physical properties of the oil, the spring force exerted by spring 210, and the flow restriction provided by fluid flow restriction 214. These parameters can be adjusted to provide the desired time delay. The purpose of the timer means 206 is to allow the fluid sampling apparatus 120 to be lowered into its final position within the well 11 as illustrated in FIG. 1 prior to the time at which the blocking valve 188 opens to permit the sample valve means 166 to move downward within the body 122 so as to permit the sample chamber 148 to be filled with a well fluid sample.

The timer means 206 includes a lost motion linkage 218 having members 220 and 222 connected to the valve sleeve 200 and the timing piston 208, respectively. This lost motion linkage 218 causes the valve sleeve 200 to be pulled to its open position only after the timing piston 20B has moved through a predetermined distance relative to the body 122. The members 220 and 222 include overlapping projections 224 and 226, respectively, which are engaged with each other after the timing piston 208 has moved through a predetermined distance, and after which engagement the members 220 and 222 move together to pull the valve sleeve 200 to an open position.

Figure 6A:
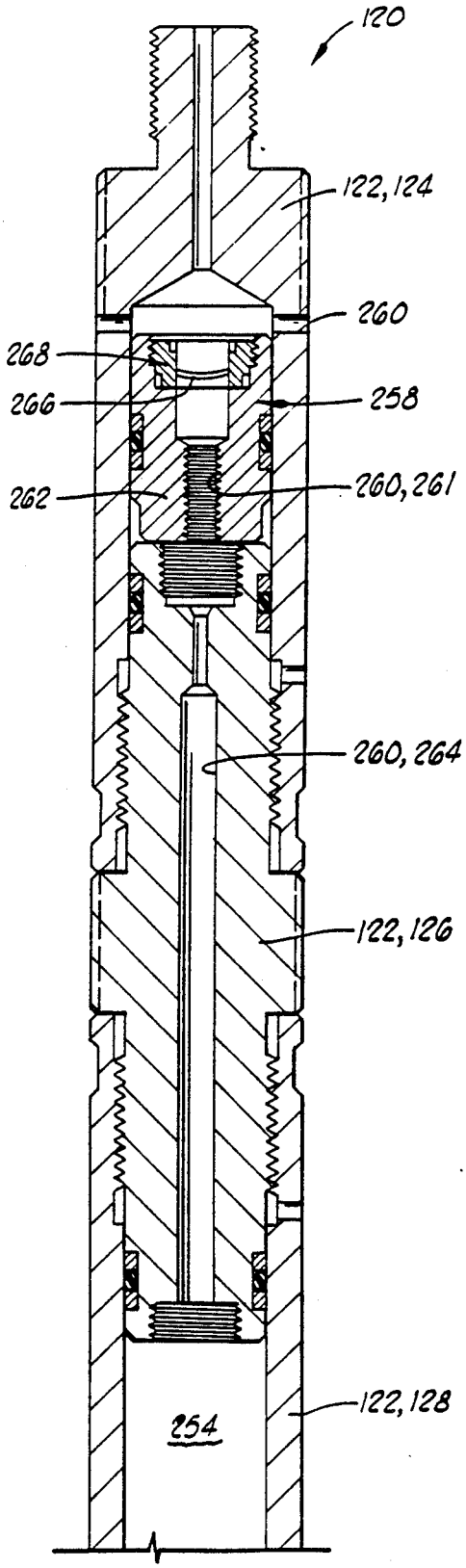
FIGS. 6A–6H comprise an elevation sectioned view of a second embodiment of the present invention. The apparatus of FIGS. 6A–6H utilizes a blocking valve to initially hydraulically block the sample valve. A hydraulic timer provides a second time delay prior to the opening of the blocking valve. A mechanical initiator seen in FIG. 6H starts the hydraulic timer prior to placement of the apparatus in the well. A disabling means seen in FIG. 6A prevents the trapping of a fluid sample at pressures above a predetermined level. The apparatus in FIGS. 6A–6H is shown in its initial position as it is being run into a well.
Figure 6B:
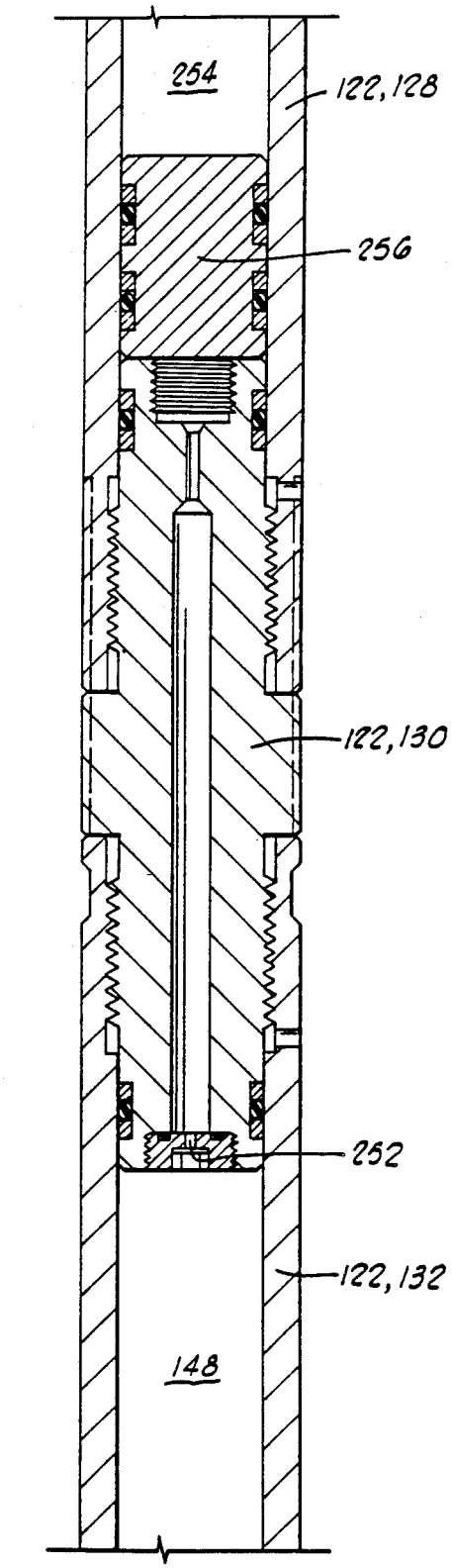
Figure 6C:
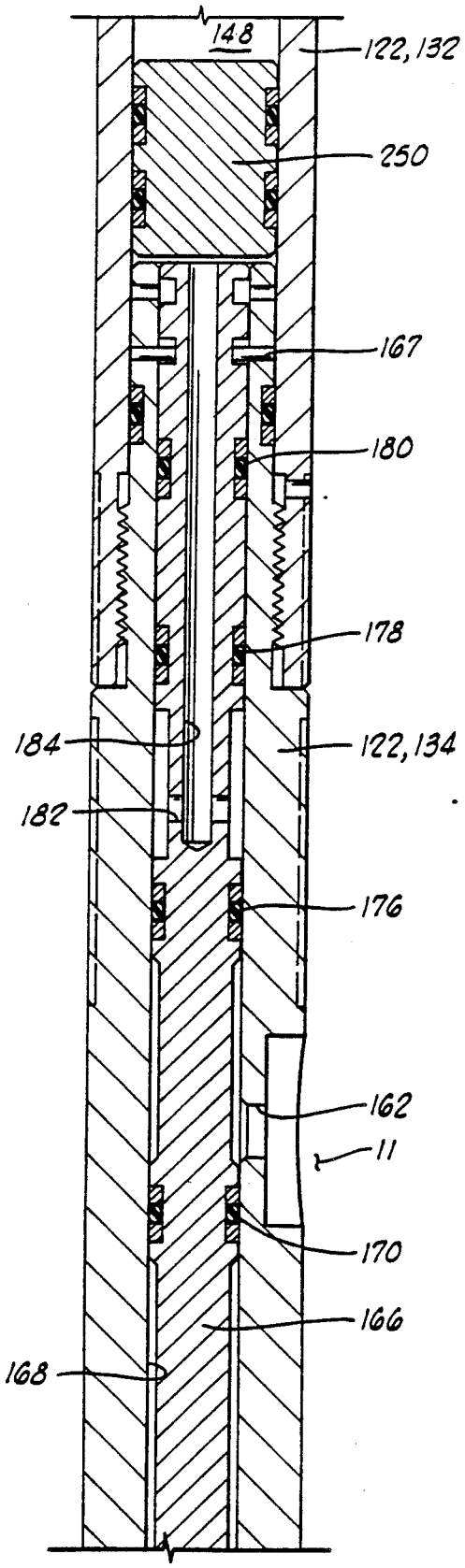
Figure 6D:
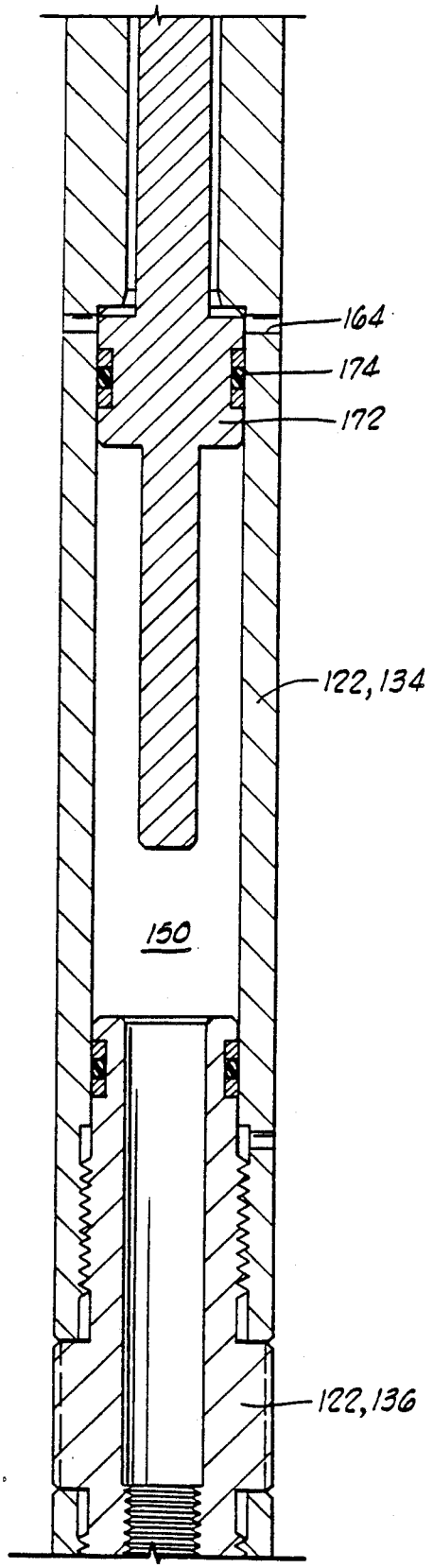
Figure 6E:
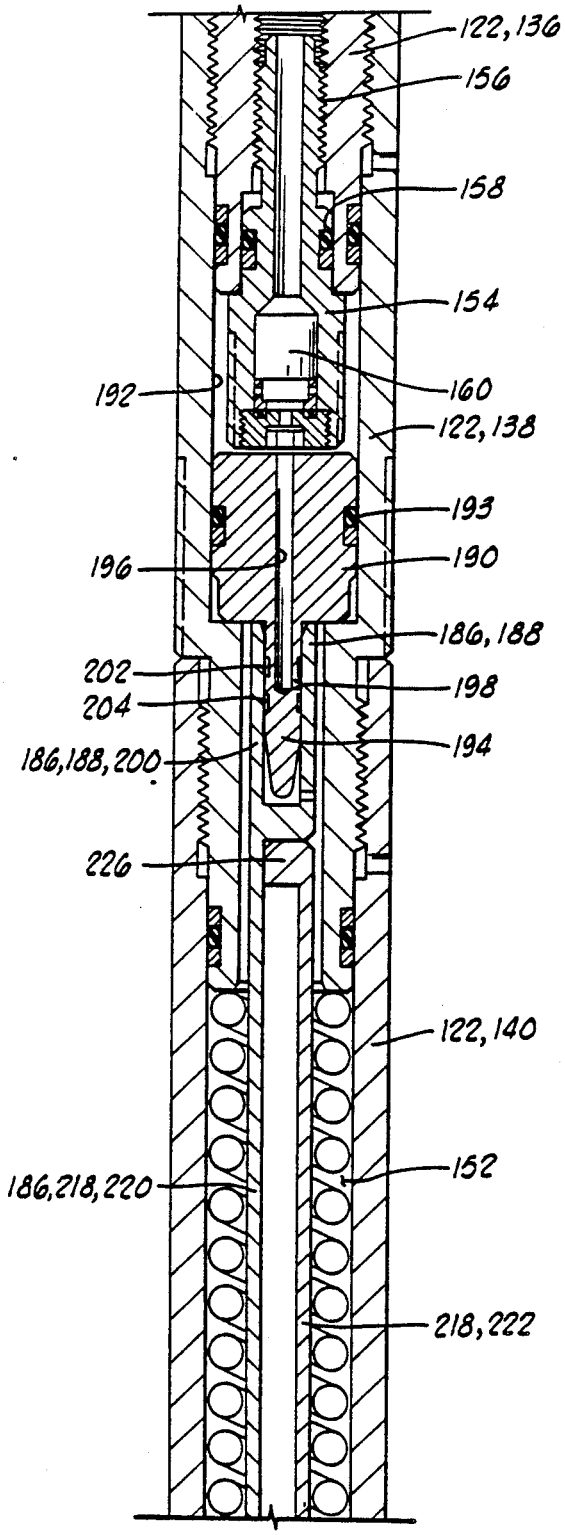
Figure 6F:
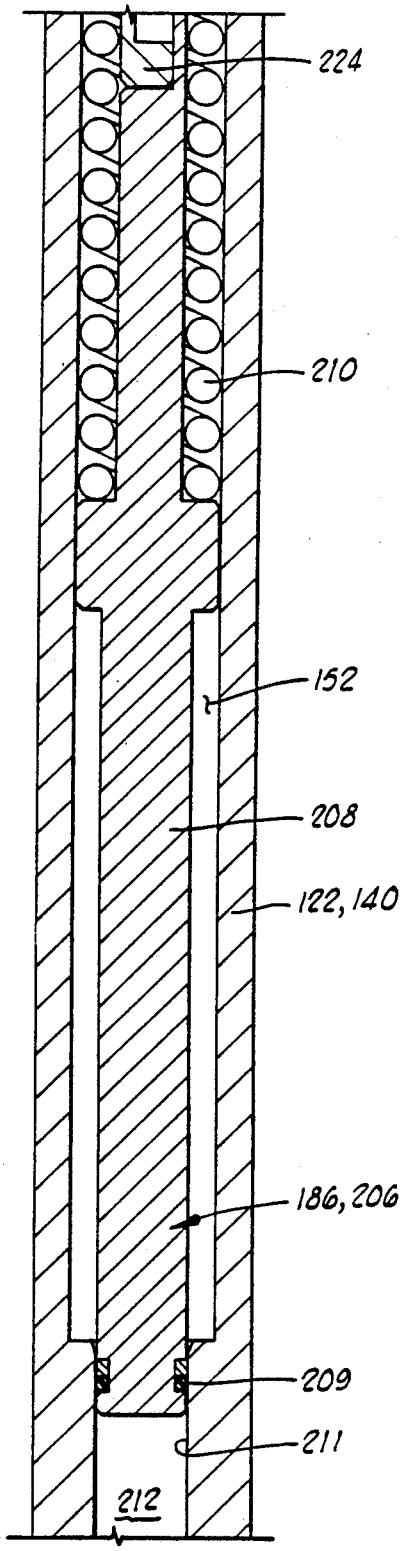
Figure 6G:
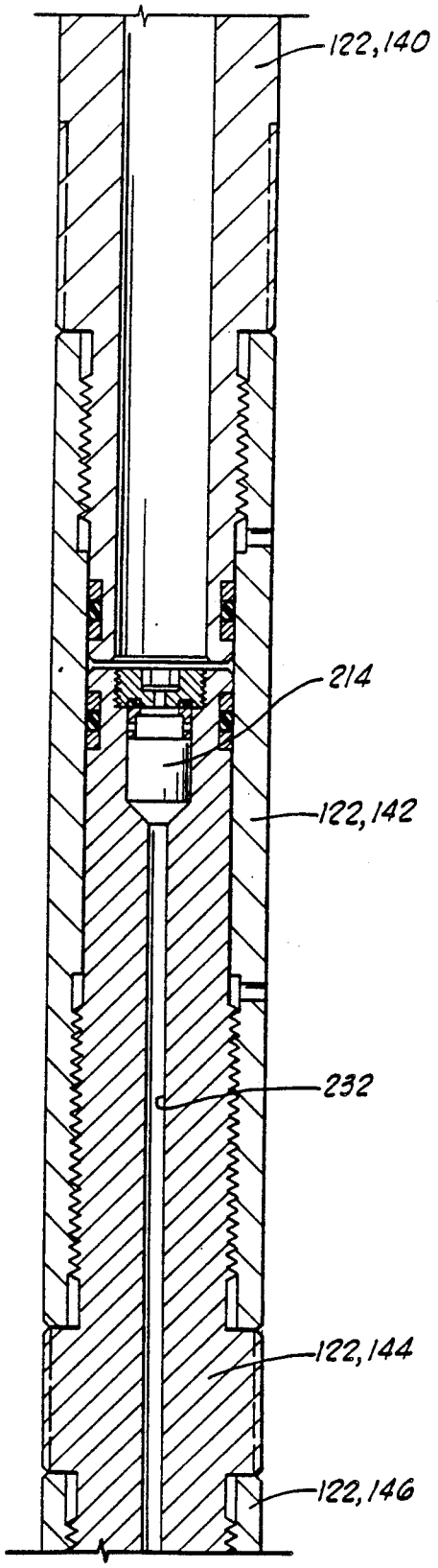
Figure 6H:
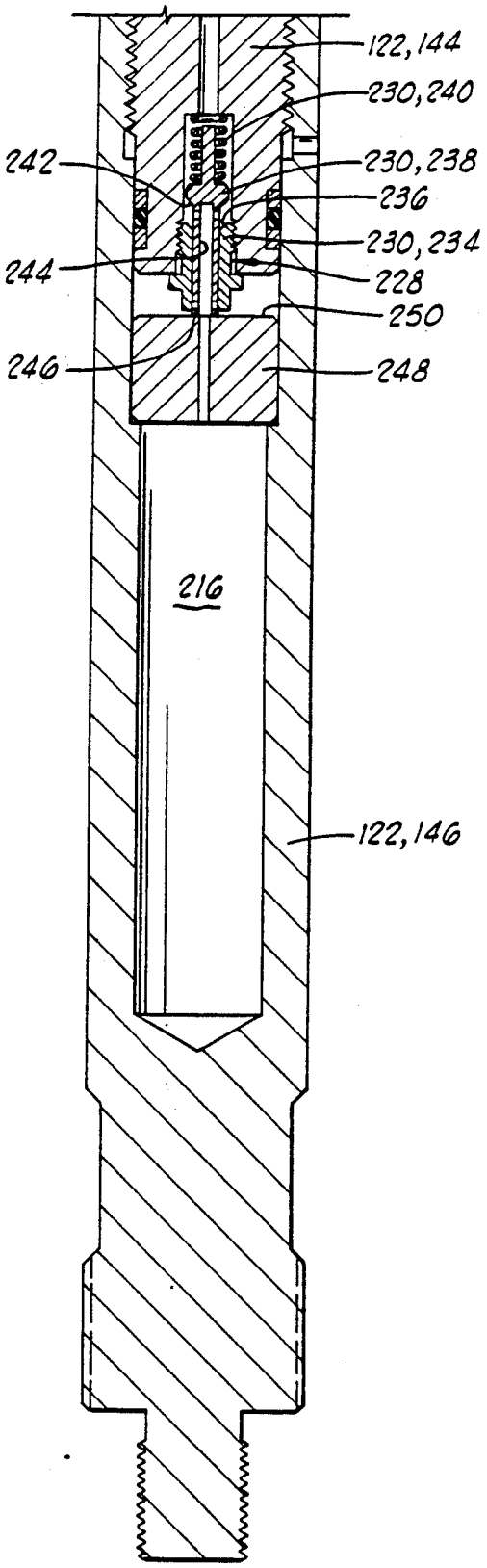

Referring now to FIG. 6H, the fluid sampling apparatus 120 further includes a mechanical initiating means 228 for starting the hydraulic timer means 206 prior to placement of the fluid sampling apparatus 120 within the well 11. The mechanical initiating means 228 includes an initiator valve 230 located hydraulically in series with the fluid flow restriction 214 of the hydraulic timing means 206. Initiator valve 230 is communicated with fluid flow restriction 214 through a passageway 232 defined through the lower adapter 144 of body 122. The initiator valve 230 is mounted in the lower end of lower adapter 144. Initiator valve 230 includes a valve seat insert 234 threadedly connected to the lower end of lower adapter 144 and having a tapered valve seat 236 defined thereon. Initiator valve 230 also includes a poppet 238 biased by valve spring 240. Poppet 238 has a tapered surface 242 defined thereon which when engaged with valve seat 236 will block the passageway 232.

Initiator valve 230 is shown in FIG. 6H in an open position wherein fluid may flow downward through the fluid flow restriction 214, the passageway 232, and through a poppet passageway 244.

It is noted that the valve spring 240 biases the poppet 238 toward a closed position in which a lower end 246 of the poppet 238 extends downward through the valve seat insert 234.

The lower end coupling 146 carries an engagement spool 248 which has an engagement surface 250 defined on the upper end thereof. The engagement surface 250 holds the poppet 238 in an open position as seen in FIG. 6H when the lower end coupling 146 is threadedly connected to the lower adapter 144.

The initiator valve 230 allows the hydraulic timer means 206 to be started just prior to the time the fluid sampling apparatus 120 is placed in the well 11. It will be appreciated that the lower end coupling 146 is not assembled with the remainder of the fluid sampling apparatus 120 until such time as it is desired to start the hydraulic timer means 206 immediately prior to placement of the tool in the well 11. The timer 206 is started by connecting the lower end coupling as just described, thus moving the spring biased poppet 238 to the open position illustrated in FIG. 6H. This permits the spring biased timing piston 208 to begin pushing hydraulic fluid from the lower oil chamber 212 through the fluid flow restriction 214 into the dump chamber 216. The hydraulic timer means 206 is constructed so as to provide sufficient time for the fluid sampling apparatus 120 to be lowered to its desired position within the well 11 before the blocking valve 188 is opened to permit a fluid sample to be taken.

Preferably with this version of the tool 120 having the mechanical initiating means 228, the hydraulic timer 206 is started by fully assembling the body 122 prior to the time the tool is placed in the well, and the hydraulic timer 206 does not finish displacing the entire volume of hydraulic fluid through the fluid flow restriction 214 until after the tool has been completely run to its final position within the well 11. The hydraulic timer 206 is designed so as to provide a sufficient time delay so that there is plenty of time for the tool to be placed at its final depth in the well before the blocking valve 188 is opened and the sample valve means 166 begins to move to allow a sample of well fluid to flow into the sample chamber 148.

The metering time provided by the hydraulic timer means 206 is typically within the range of from two to ten hours. The metering time for the sample valve 166 to move from a closed to an open position after it begins moving is typically about five minutes. Both of these times can of course be adjusted by varying the construction of the apparatus.

Looking now at the upper end of the apparatus 120 as seen in FIGS. 6A–6C, a couple of other modifications of the device as compared to the device of FIGS. 2–5 are seen.

In the device of FIGS. 2–5, the sample chamber 34 was initially filled with air which was compressed as the floating piston 108 moved upward within the chamber as the chamber filled with a fluid sample. In the apparatus 120, on the other hand, the sample chamber 148 is initially filled with oil above a floating piston 250. There is a restricted orifice 252 mounted in the intermediate adapter 130. The sample chamber 148 is communicated through the restricted orifice 252 with an upper air chamber or upper dump chamber 254. A second floating piston 256 is initially located in the lower end of air chamber 254.

When the sample valve means 166 moves downward relative to body 122 to allow fluid from the well 11 to flow through the sample port 162 into the sample chamber 148, the oil initially filling sample chamber 148 above the floating piston 250 is forced relatively slowly upwardly through the restricted orifice 252 into the dump chamber 254 below the second floating piston 256

The purpose of the dual floating piston arrangement on the upper end of FIG. 6 is to keep the well fluid entering the sample chamber 148 from experiencing a significant pressure drop as the sample chamber 148 fills. If the fluid experiences a large enough pressure drop, the gas in the sample can flash, degrading the quality of the sample.

An additional feature seen near the upper end of FIG. 6A is a disabling means 258 for disabling the fluid sampling apparatus 120 when pressure in the well 11 exceeds a predetermined level.

The body 122 has a pressure relief passage 260 defined therein and communicated with the well 11. The pressure relief passage 260 may be considered to include a cartridge passage 261 through a rupture disk cartridge 262 and a bore 264 through upper coupling adapter 126 which is communicated with the dump chamber 254. Thus, the pressure relief passage 260 communicates the well 11 outside the body 122 with the dump chamber 254 and across floating piston 256 with the sample chamber 148.

The disabling means 258 includes a rupture disk 266 held by a threaded disk insert 268 in the cartridge 262 so that the rupture disk 266 blocks the pressure relief passage 260. The rupture disk 266 is constructed to rupture when the pressure differential between the well 11 and the substantially atmospheric pressure contained in dump chamber 254 exceeds a predetermined level above which it is undesirable to trap a sample of fluid.

If the fluid sampling apparatus 122 encounters pressure within the well 11 in excess of the level at which the rupture disk 266 is designed to rupture, the disk 266 will rupture thus allowing well fluid pressure to be communicated to the dump chamber 254 and across the floating piston 256 to the hydraulic fluid initially contained in the sample chamber 148 above the floating piston 250. Thus, when the sample valve means 166 later is moved downward, a fluid sample will not flow through the sample port 162 and into the sample chamber 148. This is because the well fluid pressure will be present on both sides of the floating piston 250 thus balancing well fluid pressure across the sample chamber 148.

Thus, the disabling means 258 prevents the trapping of a fluid sample in the sample chamber 148 at a pressure in excess of the predetermined pressure at which the rupture disk 266 is designed to rupture.

This is a significant safety feature. For example, if a sample is trapped at too high a pressure, the gases from the sample may leak past the seals defining the sample chamber 48 when the fluid sampling tool 120 is pulled out of the well 11. If those gases contain poisonous components, this presents a safety hazard to personnel operating the well.

Also, the laboratory equipment utilized to remove and test the fluid samples may not be able to satisfactorily handle samples above a certain pressure. Again, the proper selection of rupture disk 266 will insure that samples are not inadvertently trapped at pressures in excess of those which can be safely handled.

It will be appreciated that the disabling means 258 is useful on tools other than the sampling tool disclosed herein. It could be used on any tool designed to operate in response to well pressure. The fluid sampling tool 120 can generally be described as having a body 122 with a low pressure chamber 148 defined therein, and having a first port 162 defined through the body 122. The floating piston 250 can be generally described as a pressure responsive operating mechanism 250 disposed in the body 122 and having its lower side communicated with the well through the port 162 and having its upper side communicated with the low pressure chamber 148. The rupture disk 266 placed in the pressure relief passage 260 thus provides a disabling means for disabling the apparatus when fluid pressure in the well exceeds the predetermined level at which the rupture disk 266 will rupture. When the rupture disk 266 ruptures fluid pressure from the well is communicated to the low pressure zone 148 and thus to the upper side of the floating piston operating mechanism 250.

The general manner of operation of fluid sampling apparatus 120 is as follows. The apparatus 120 is shown in FIGS. 6A–6H in its initial position in which it is lowered into the well. The apparatus is shown in FIGS. 7A–7H in its final position after the hydraulic timer 206 has opened the blocking valve 188 and allowed the sample valve means 166 to slide downward within the body 122 thus filling the sample chamber 148.

As previously noted, the hydraulic timer means 206 is started by the mechanical initiation means 228 upon assembly of the lower end coupling 146 with the remainder of the body 122. This starts a first predetermined time period which may be on the order of two to ten hours prior to the time at which the locking valve 188 is opened. This first time interval allows the fluid sampling apparatus 120 to be lowered into the well 11 to its desired location at which the well 11 is to be sampled.

When the hydraulic timer means 206 does open blocking valve 188, the external well pressure acting through power port 164 acts downward on the piston 172 shearing shear pins 167 and slowly pulling the sample valve means 166 downward within the body 122 as hydraulic fluid from oil chamber 150 slowly meters through the restricted orifice 160 into the air chamber 152.

Figure 7A:
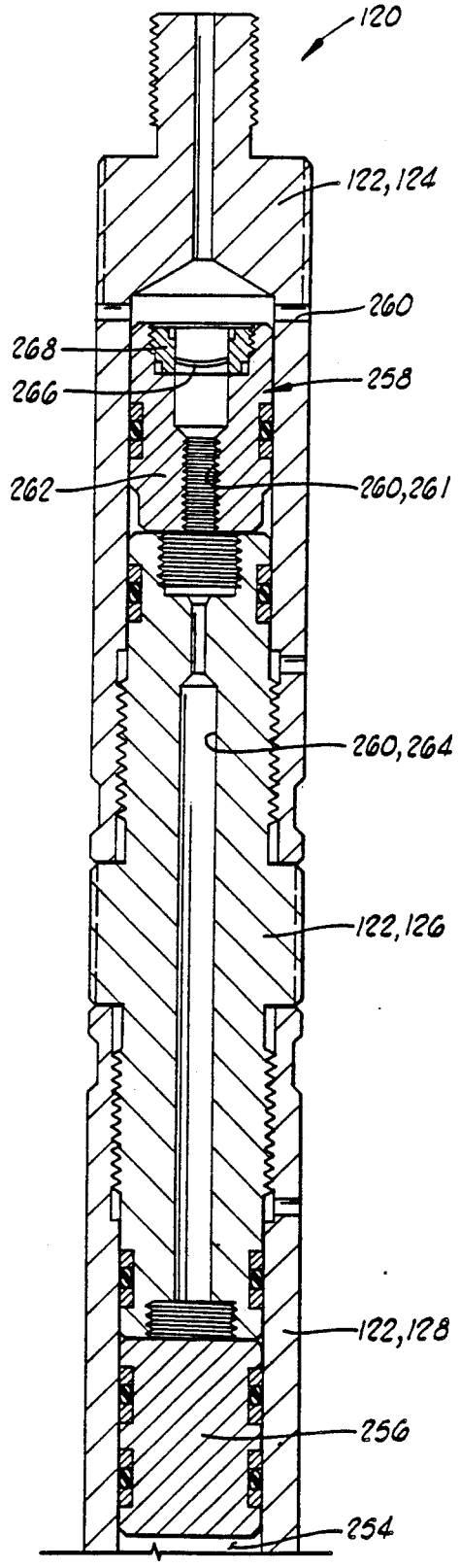
FIGS. 7A–7H show the apparatus of FIGS. 6A–6H in its final position after it has been placed in a well and a well sample has been trapped therein.
Figure 7B:
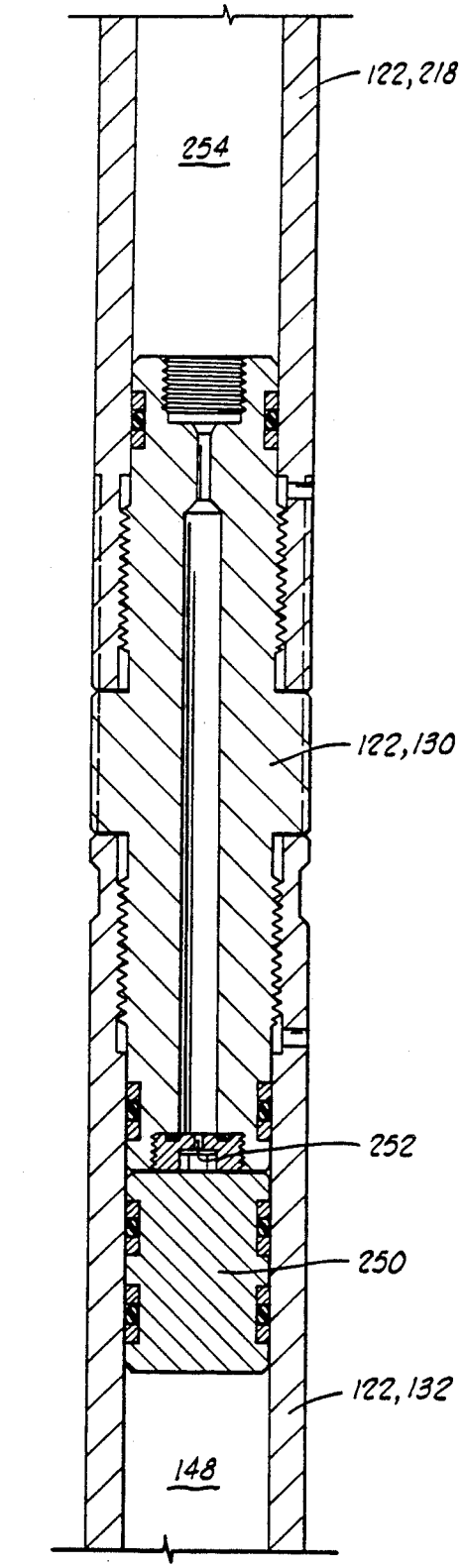
Figure 7C:
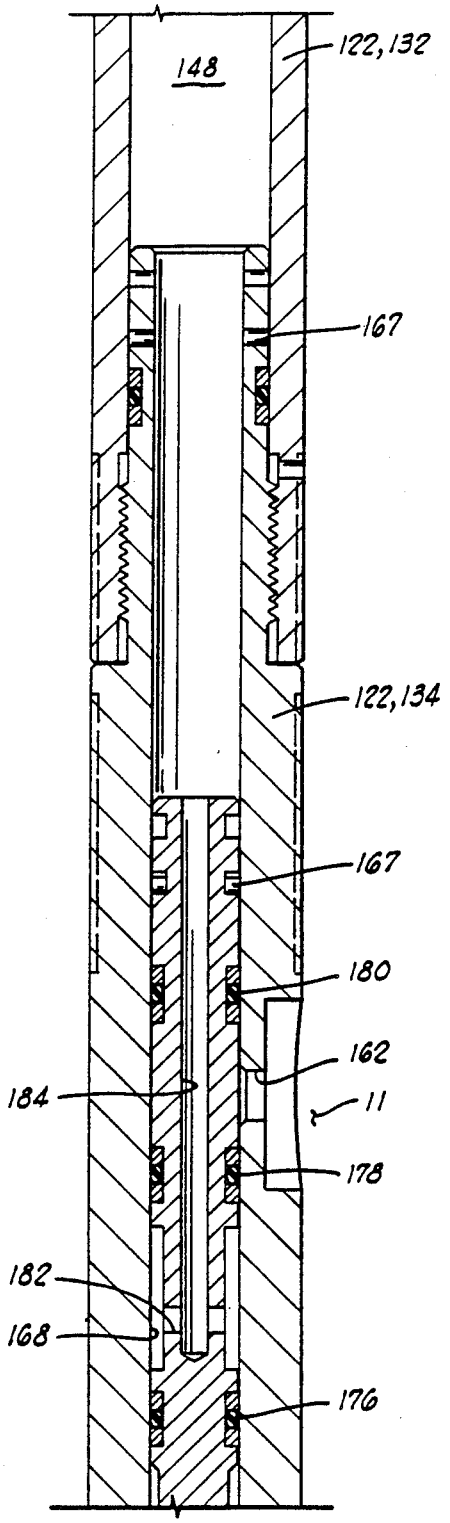
Figure 7D:
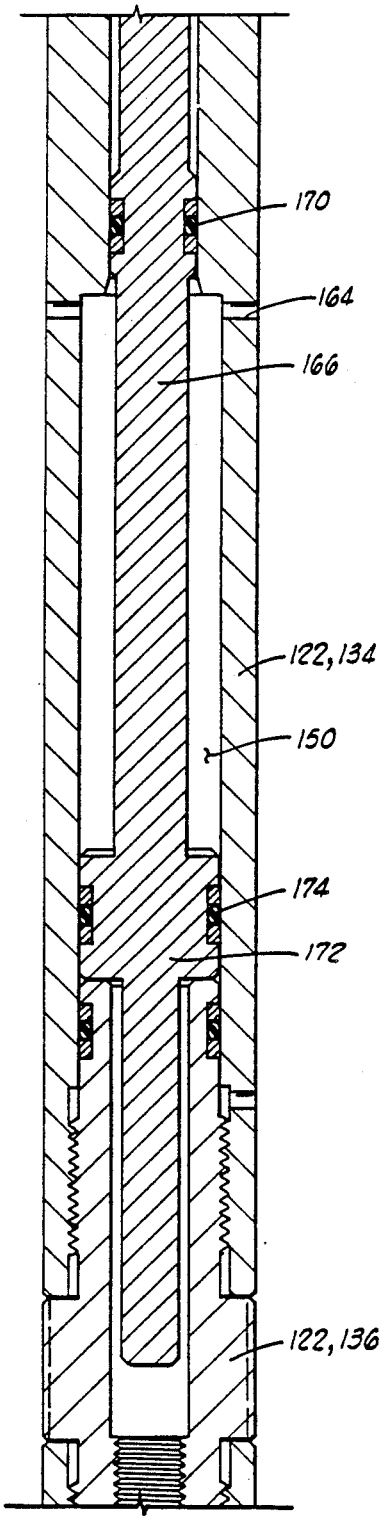
Figure 7E:
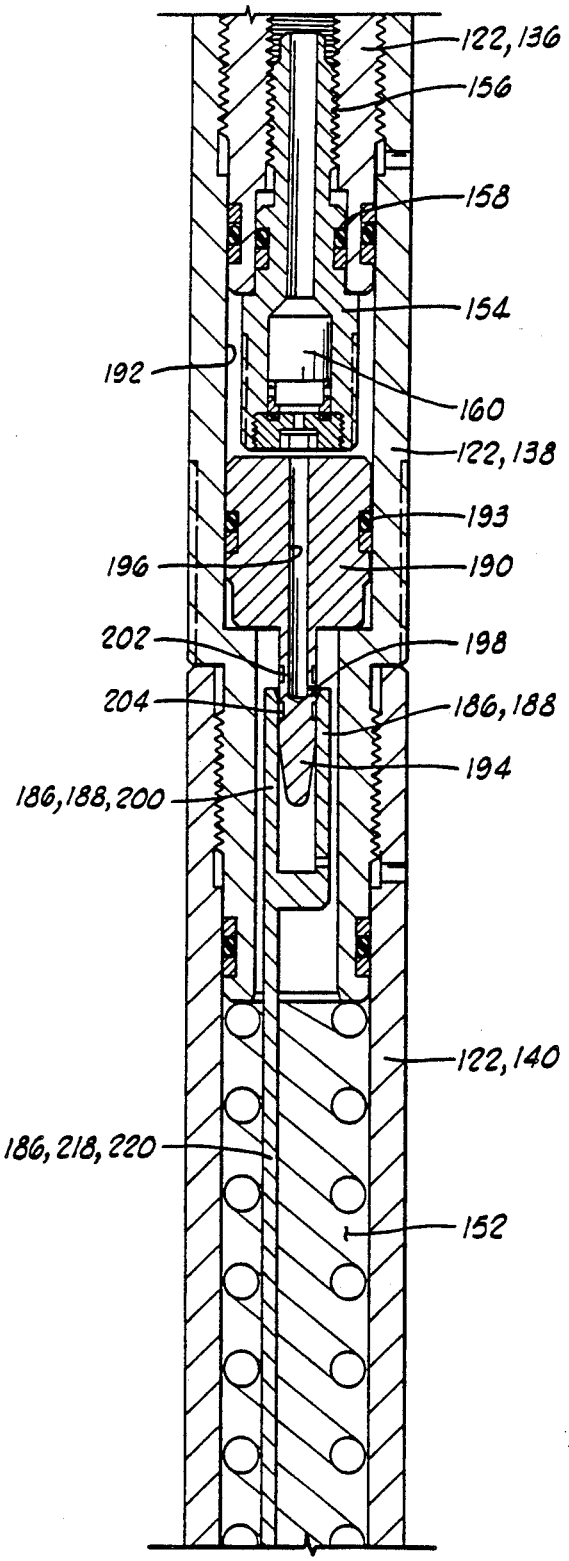
Figure 7F:
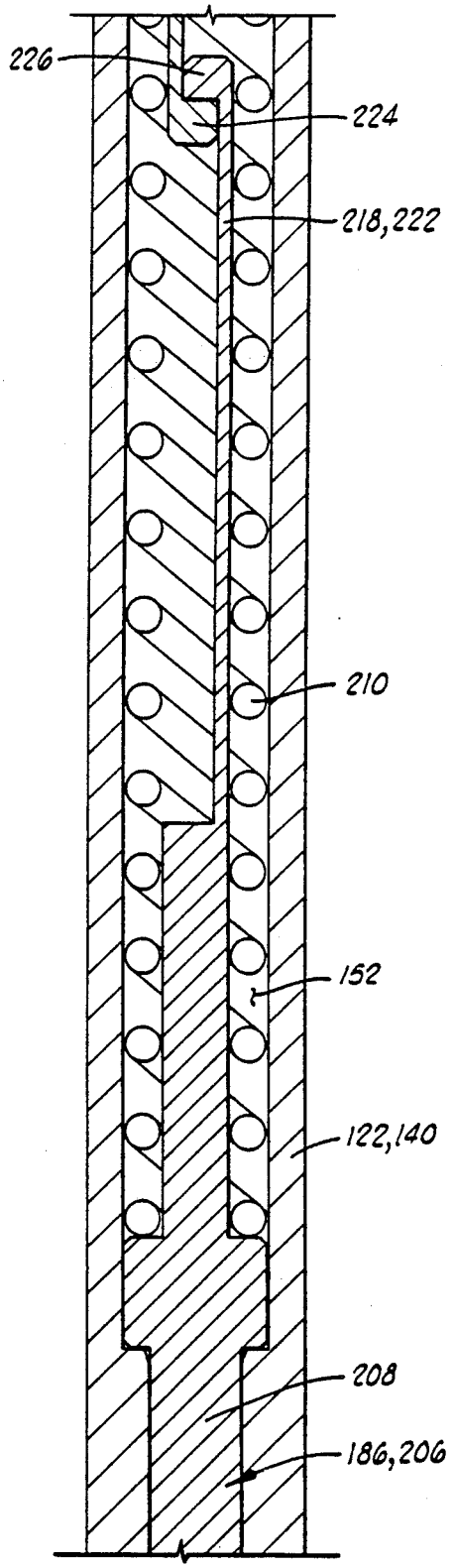
Figure 7G:
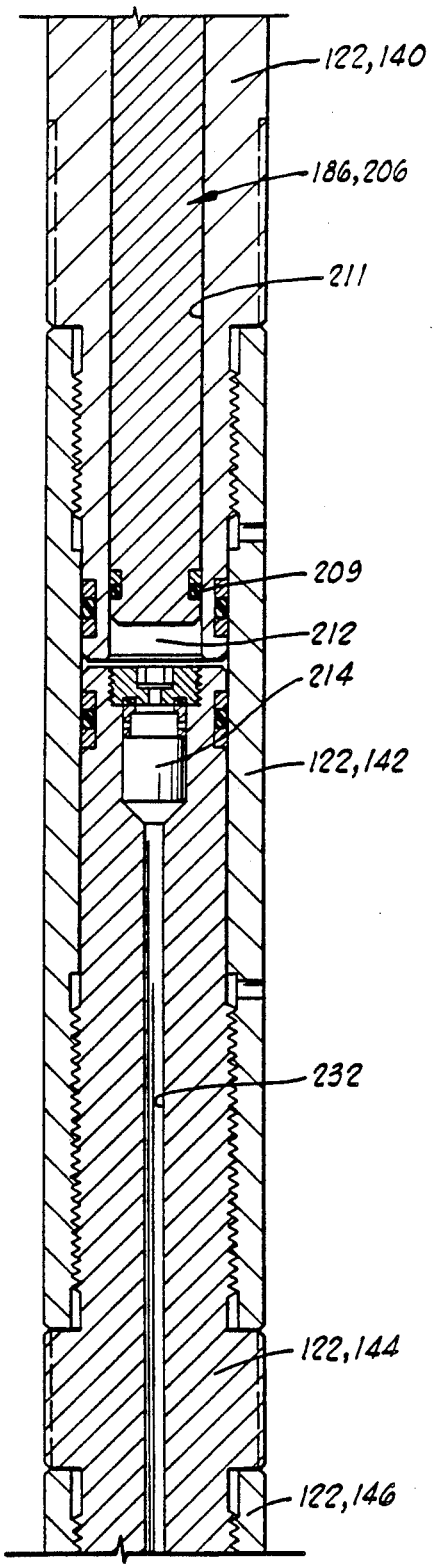
Figure 7H:
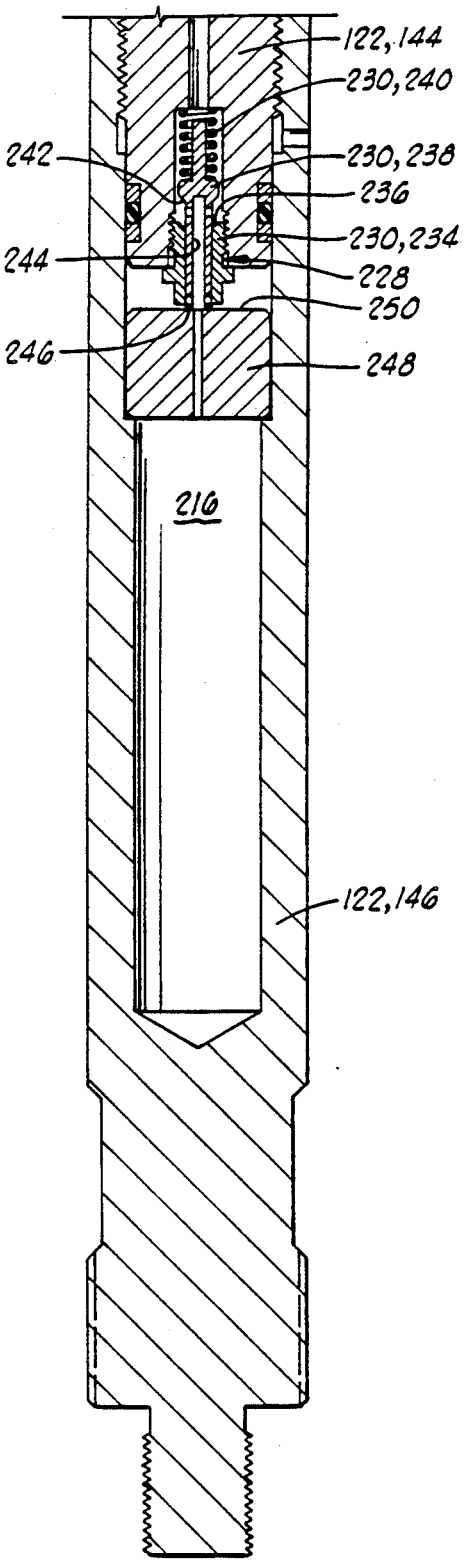

When the seal 176 moves below sample port 162 well fluid flows through fill port 182 and fill passage 184 into the sample chamber 148 below the floating piston 250. The floating piston 250 moves upward forcing the hydraulic fluid which initially fills sample chamber 148 above floating piston 250 through the restricted orifice 252 into the upper dump chamber 254 below second floating piston 256. Prior to the time seal 178 passes sample port 162, there is sufficient time for the sample chamber 148 to completely fill with a sample of well fluid. When the valve 166 reaches its final position as illustrated in FIGS. 7C–7D, the seals 178 and 180 are on opposite sides of sample port 162 thus sealing the well fluid sample within the sample chamber 148.

There is a significant advantage to the apparatus 120 having separate sample port 162 and fill port 164 as compared to the apparatus of FIGS. 2A–2D wherein the sample port 140 serves the dual function of permitting the sample to flow into the sample chamber and communicating well pressure with the piston to actuate the sliding sample valve. As is best seen in FIG. 5, with the apparatus 10 of FIGS. 2–5, the sample chamber 34 is communicated through passage 102 and port 100 with a substantial volume of annular space 272 above the piston 88. With the apparatus of FIGS. 2–5, the fluid contained in sample chamber 34 and in that annular space 278 must be compressed in order to move the sample valve means 70 back upward to a position wherein the sample can flow back out through the sample port 40.

With the apparatus of FIGS. 6 and 7, on the other hand, the annular space 274 (see FIG. 7D) above the piston of the valve means 166 is not in communication with the sample chamber 148, and thus there is much less compression of the fluid in the sample chamber 148 necessary to move the valve means 166 upward to a position wherein the sample can be removed through the sample port 162. Thus, there is less degradation of the well fluid sample.

Seals 170, 176, 178 and 180 collectively provide a seal means between the sample valve means 166 and the body 122 for isolating the sample chamber 148 from the annular portion 274 of the oil chamber 150 above the enlarged diameter piston 172, and also for isolating the sample chamber 148 from both the sample port 162 and the power port 164 after the sample chamber 148 is filled with sample fluid from the sample port 162.

Figure 13A:
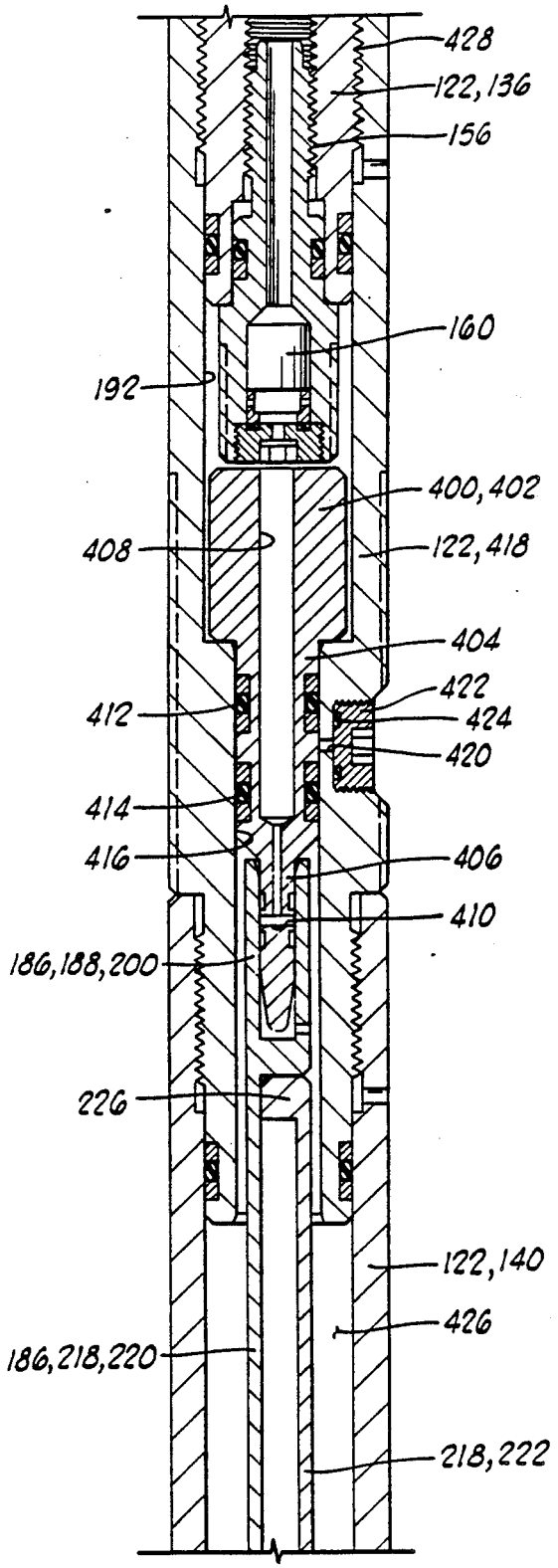
FIGS. 13A–13B illustrate another modification of the apparatus of FIGS. 6A–6H in which the hydraulic timer has been modified to utilize a compressed gas spring rather than the mechanical spring illustrated in FIGS. 6E–6F.
Figure 13B:
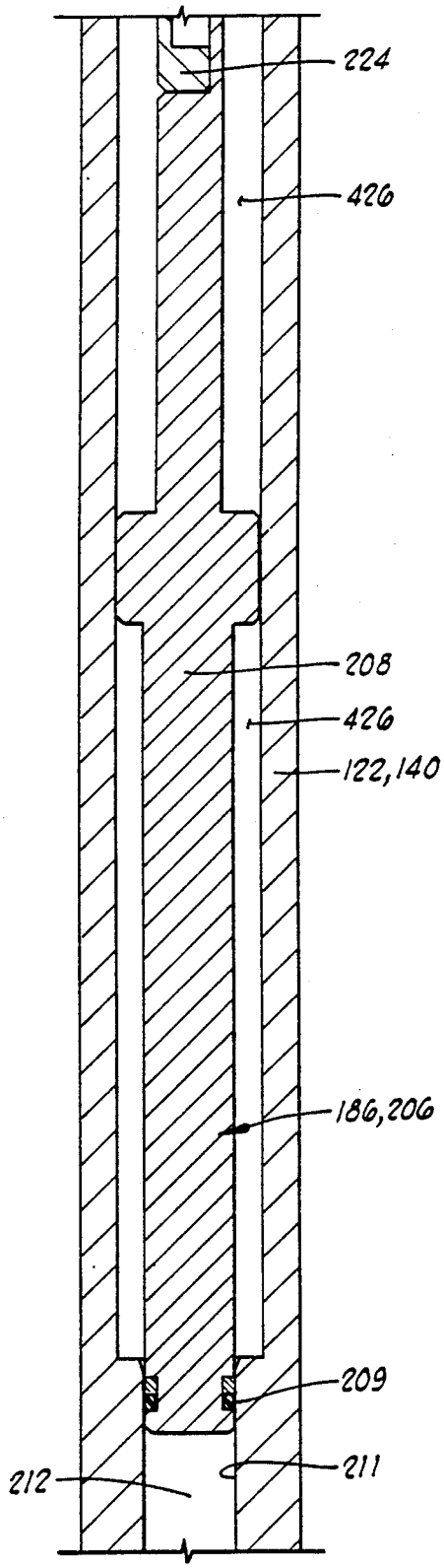

The Embodiment of FIGS. 13A–13B

FIGS. 13A–13B show a modified version of the apparatus like that of FIGS. 6 and 7 in which the mechanical spring 210 of the hydraulic timer means 206 has been replaced with a compressed gas spring.

The valve body has been modified and is now designated by the numeral 400. Valve body 400 has upper portion 402, reduced diameter intermediate portion 404, and further reduced diameter neck portion 406. Valve passage 408 extends downward into valve body 400 and intersects radially extending valve ports 410. Intermediate portion 404 carries first and second O-ring seals 412 and 414.

Intermediate portion 404 is closely received in a bore 416 of a modified blocking means housing section 418. A gas fill port 420 is disposed through housing section 418 and is closed by a threaded plug 422 having O-ring seal 424.

In the position shown in FIGS. 13A–13B the seals 412 and 414 are on opposite sides of fill port 420 thereby blocking fill port 420. A gas chamber 426 within spring housing section 140 has already been filled with nitrogen gas at a pressure in the range of about 500 to about 1000 psi. This pressure acts downward on the circular area within O-ring seal 209 of timing piston 206, thus providing a compressed gas spring acting against timing piston 206.

The gas chamber 426 is filled in the following manner during assembly of the apparatus. A gas fill valve (not shown) is connected to fill port 42 in place of the plug 422. Prior to making up a threaded connection 428 between drain nipple 136 and housing section 418, the valve body 400 is only partially inserted into bore 416 with seal 414 being located in bore 416 above fill port 420. Sleeve 200 is already in place over neck portion 406 thus closing valve port 410. The thread 428 is partially made up to hold the valve body 400 in the position just described. The gas chamber 426 then is filled with pressurized nitrogen gas and afterward the thread 428 is completely made up thus pushing valve body 400 down to the position of FIG. 13A blocking fill port 420. Then the gas fill valve is removed and plug 422 is put in place.

The gas chamber 426 preferably has a volume such that the gas expands on the order of about thirty percent as the timing piston 206 moves through its full length of travel.

A primary advantage of the compressed gas spring of FIG. 13 as compared to the mechanical spring of FIG. 6 is that the gas spring is more reliable at elevated temperatures. The gas spring design is limited only by the temperature resistance of seals associated with gas chamber 426. Those seals are preferably formed of a Viton material capable of resisting temperatures up to about 500° F. Mechanical springs, by contrast, start to become less predictable at temperatures above about 300° F.

Figure 8:
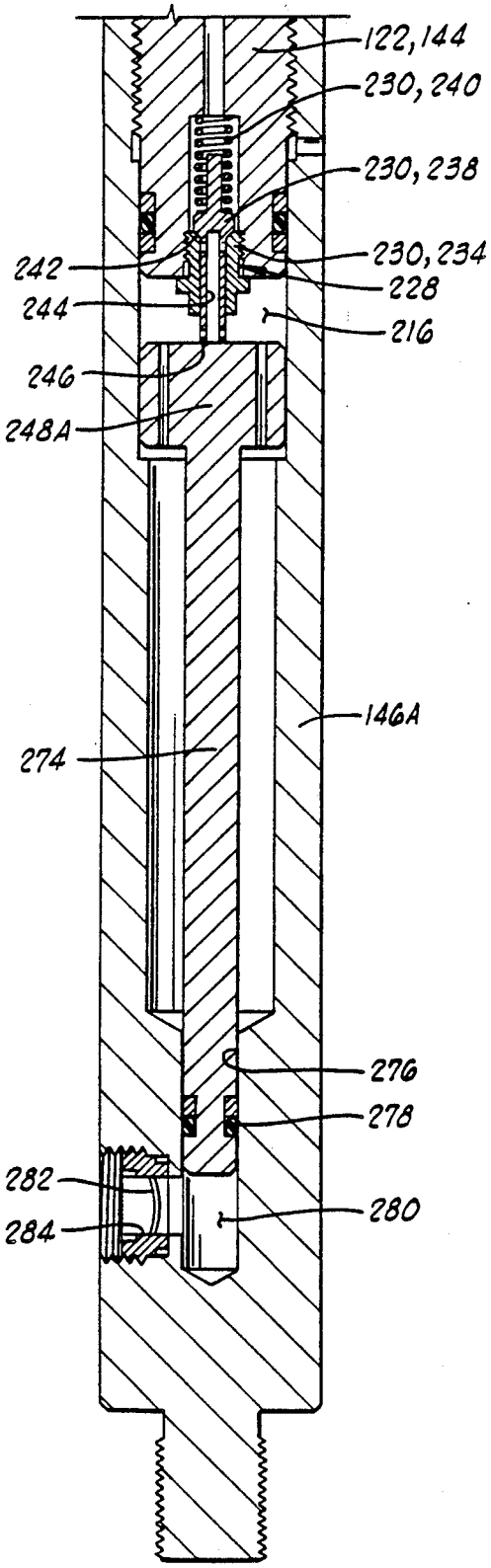
FIG. 8 illustrates a modification of the lower end of an apparatus like that of FIGS. 6A–6H to provide a pressure responsive switching means for starting the hydraulic timer in response to an increase in well pressure above a predetermined level.

The Embodiment of FIG. 8

FIG. 8 illustrates an optional modification of the apparatus of FIGS. 6A–6H. FIG. 8 generally corresponds to the structure seen in FIG. 6H.

In FIG. 8, the lower end coupling 146 of FIG. 6H has been replaced with a modified coupling 146A. The engaging spool 248 has been replaced with a modified engaging spool 248A having a pressure responsive piston 274 extending downward therefrom and received within a bore 276 with an O-ring seal 278 provided therebetween. An air chamber 280 is defined below the piston seal 278. The air chamber 280, which is initially at substantially atmospheric pressure when the tool is assembled, is separated from the fluid in the well by a rupture disk 282 which closes a radial port 284. The rupture disk 282 and piston 274 associated with the engagement spool 248A collectively provide a pressure responsive switching means for starting the hydraulic timer means 206 in response to an increase in well pressure to a predetermined level at which the rupture disk 282 is designed to rupture.

This pressure responsive switching means includes the switching piston 274 having its upper end exposed to the low pressure chamber 216. The rupture disk 282 provides a means for initially isolating the switching piston 274 from the well fluid pressure until that well fluid pressure reaches a predetermined level at which the rupture disk 282 ruptures thus allowing well fluid to enter the atmospheric chamber 280 thus creating an upward pressure differential across the piston 274.

Thus, with the modified apparatus of FIG. 8, the hydraulic timer means 206 is not necessarily started prior to placement of the tool in the well 11. The rupture disk 282 can be designed so that it will rupture only after the tool has been lowered to a certain depth within the well 11.

The advantage of this activation method is that no metering time will be used until the tool experiences a significant pressure level. This means that no metering time will be wasted while the tool is being rigged up to be placed in the well.

Figure 9:
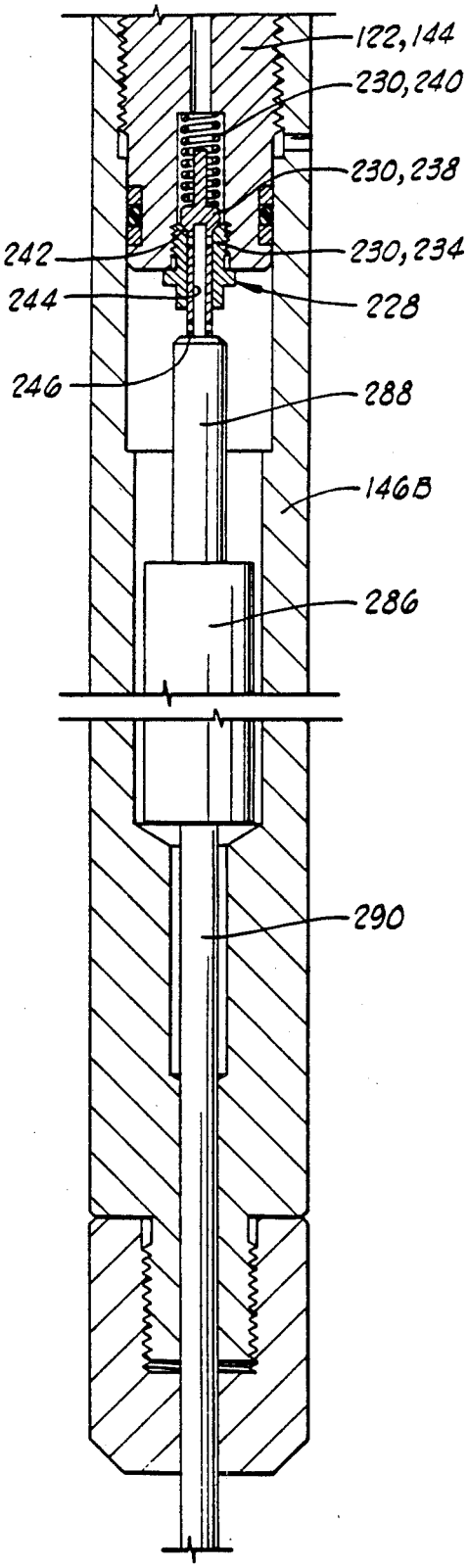
FIG. 9 illustrates another modification of an apparatus like that of FIGS. 6A–6H providing an electrically powered initiating means for starting the hydraulic timer in response to an electrical signal transmitted from the surface. It is noted that in the embodiment of FIG. 9, the apparatus would be turned upside down as compared to the apparatus shown in FIGS. 6A–6H to accommodate the wire line which must run upward from the electrical initiator to the surface.

The Embodiment of FIG. 9

FIG. 9 illustrates yet another optional modification of the apparatus of FIGS. 6 and 7. This modification also deals with a different means for starting the hydraulic timer means 206 by opening the initiator valve 230.

In the apparatus of FIG. 9, the lower end coupling 146 has been replaced with the modified lower end coupling 146B. An electric solenoid 286 is contained within the coupling 146B and has a solenoid plunger 288 oriented to engage the end 246 of poppet 238. A wire line 290 extends from the solenoid.

It is noted that the modified apparatus of FIG. 9 must be turned upside down, so that the wire line 290 extends upward to the surface equipment 18 (see FIG. 1).

The electric solenoid 286 provides an electrically powered initiating means 286 for starting the hydraulic timing means 206 in response to a signal transmitted from a surface location 18 of the well 11 in which the apparatus is located. When the appropriate signal is transmitted to solenoid 286, the plunger 286 is extended so as to push the poppet 238 upwards thus allowing fluid to flow downward through the poppet passage 244.

Figure 11A:
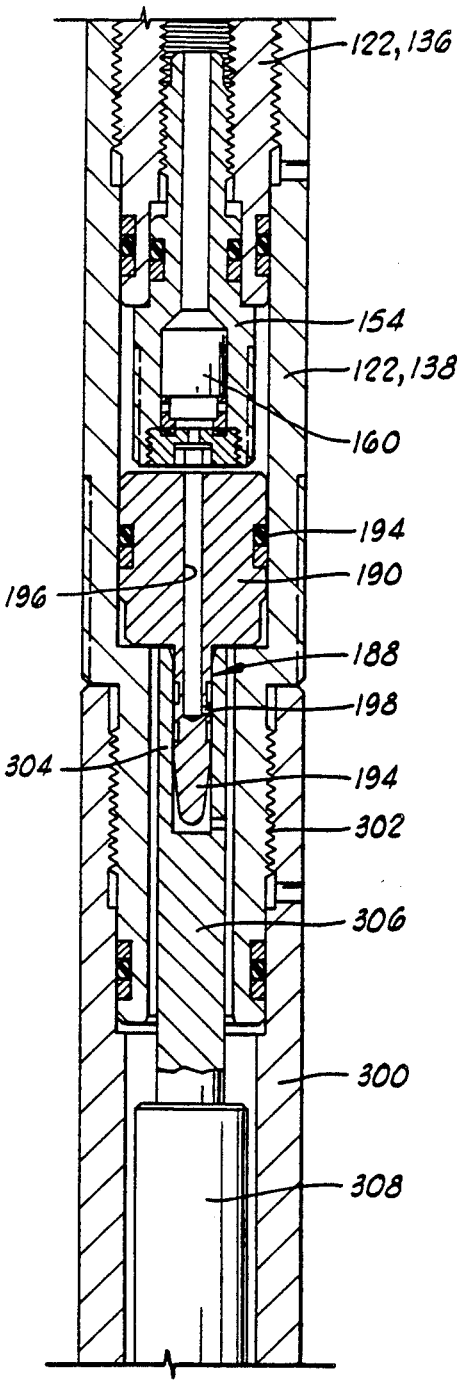
FIGS. 11A–11B illustrate another possible modification to the apparatus like that of FIGS. 6A–6H in which the hydraulic timer has been deleted and the blocking valve is operated in response to an electrical signal transmitted from the surface through a wire line. Again, to accommodate the necessary orientation of the wire line, the apparatus of FIGS. 11A–11B would be turned upside down as compared to the apparatus shown in FIGS. 6A–6H.
Figure 11B:
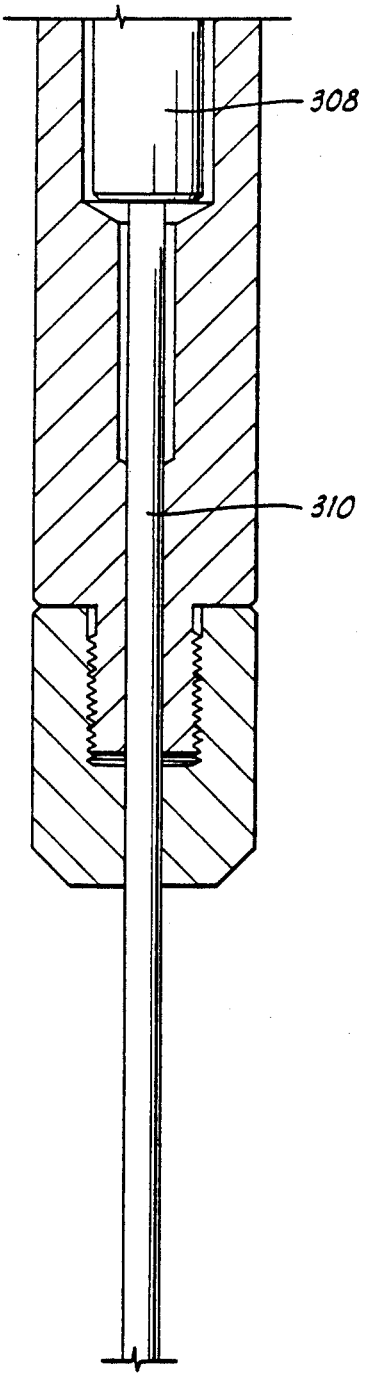

This represents an advantage in some respects as compared to direct electrical activation of the sliding valve as shown in FIGS. 11A–11B because the embodiment of FIG. 9 allows the tool to be run in wells which have bottom hole temperatures which exceed the limits of present electric components. The tool would be lowered into a high temperature well a significant distance, but not far enough for the temperature to be too great for reliable operation of the electronics. The hydraulic timer means 206 would then be activated by the electrical solenoid 286, and then the tool is lowered into the high temperature zone of the well which is to be sampled. The opening and closing of the sample valve means 166 would then be governed solely by the hydraulic timer 206 which will work reliably at elevated temperatures.

Figure 10A:
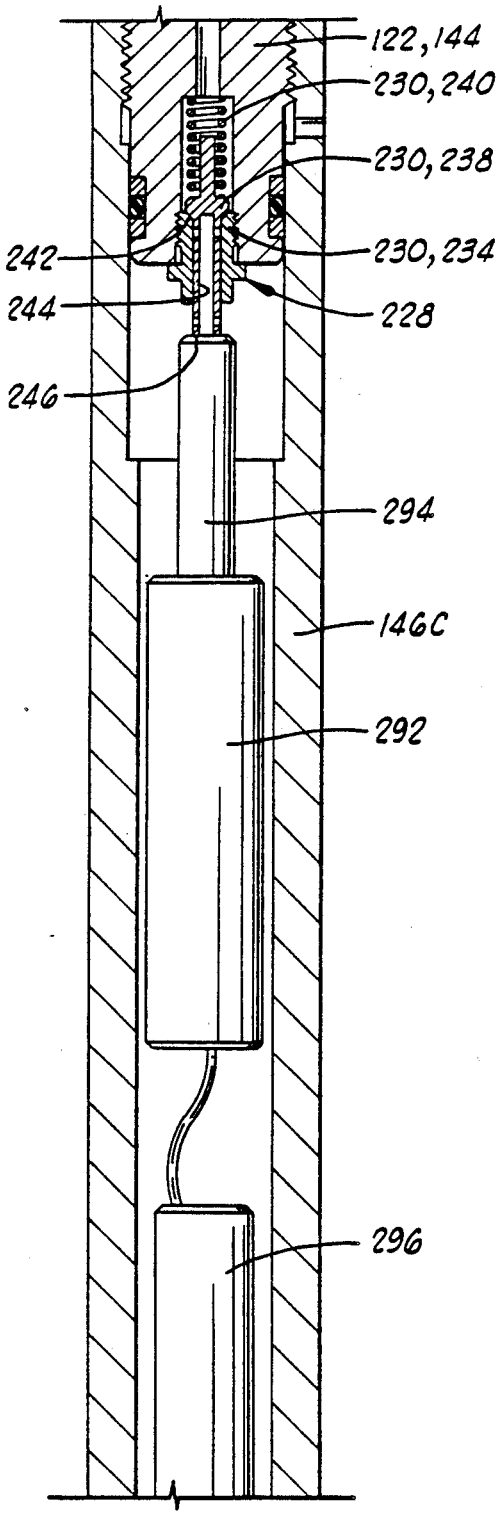
FIGS. 10A–10B show another modification of an apparatus like that of FIGS. 6A–6H in which an electronic timer means is provided for starting the hydraulic timer after a third time delay.
Figure 10B:
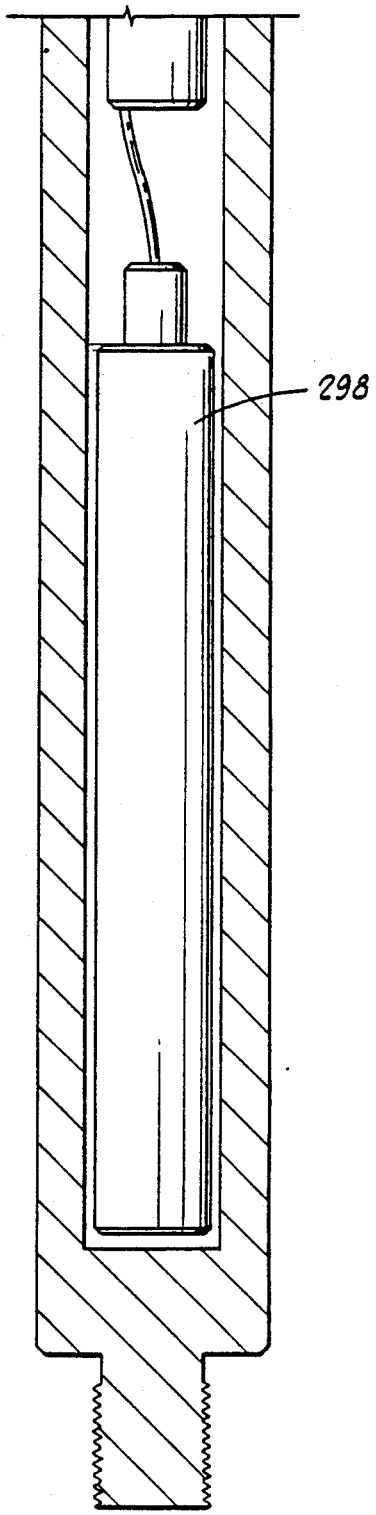

The Embodiment of FIGS. 10A–10B

FIGS. 10A–10B illustrate yet another optional modification of the apparatus of FIGS. 6 and 7, providing another means for opening the initiator valve 230. The lower end coupling 146 has been replaced with a modified lower end coupling 146C which contains an electric solenoid 292 having plunger 294 associated with the initiator valve 230 in a manner similar to that just described for FIG. 9. The apparatus of FIGS. 10A–10B however, is operated by a self-contained electronic timer 296 powered by batteries 298 all contained within the lower end coupling 146C. The timer 296 is constructed to direct electric power from batteries 298 to the solenoid valve 292 at a predetermined time so as to cause the plunger 294 to extend thus moving the initiator valve 230 to an open position.

This design allows a third predetermined time delay to be built into the fluid sampling apparatus. That is, there is a time delay determined by the electronic timer means 292, another time delay subsequently determined by the hydraulic timer means 206, and a final time delay determined by the time necessary for the sample valve means 166 to move downward through a sufficient distance to permit the sample chamber 148 to fill with well fluid.

This embodiment is used in high temperature wells as follows. The tool is run on a slick line into the well a significant distance, but not far enough for the temperature to be too high for reliable operation of the electronic timer 296 and solenoid 292. After the preset time has elapsed, so that the electronic timer 296 activates the solenoid 292 to start the hydraulic timer means 206, the fluid sampling tool is then lowered into the high temperature zone which is to be sampled. The opening and closing of the sampler valve means 166 will then be governed solely by the hydraulic timer means 206 which will work reliably at elevated temperatures.

The Embodiment of FIGS. 11A–11B

FIGS. 11A–11B illustrate yet another optional modification of an apparatus generally similar to that of FIGS. 6 and 7. In the apparatus of FIGS. 11A–11B, the hydraulic timer means has been eliminated, and has been replaced with an electric powered solenoid which open the blocking valve 188.

Approximately the upper half of FIG. 11A corresponds to the structure previously described with regard to FIG. 6E. The lower portion of FIG. 11A and all of FIG. 11B is modified.

An electric component body section 300 is connected to the blocking means housing section 138 at threaded connection 302. The sliding sleeve 200 of FIG. 6E has been replaced with a sliding sleeve 304 connected to a plunger 306 of a solenoid 308. A wire line 310 runs from solenoid 308 to the surface equipment 18 located at the surface of the well. It is noted that the apparatus of FIGS. 11A–11B must be turned upside down so as to permit the wire line 310 to run upward to the surface of the well.

In that regard, it is noted that all of the embodiments of the fluid sampling apparatus of the present invention can be operated in an inverted position.

The solenoid 308 provides an electrically powered actuating means 308 for moving the blocking valve 188 to its open position in response to a signal transmitted from a surface location 18 of the well 11 in which the apparatus is located.

Figure 12A:
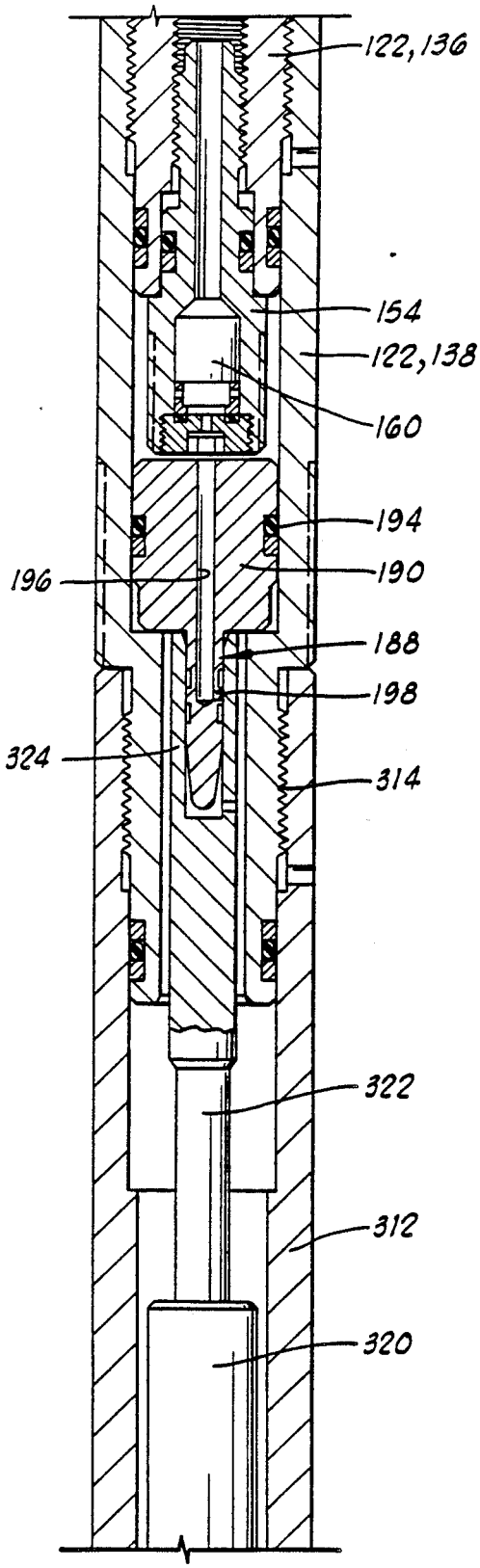
FIGS. 12A–12B illustrate yet another possible modification of the apparatus of FIGS. 6A–6B in which the hydraulic timer is replaced by an electronic timer means.
Figure 12B:
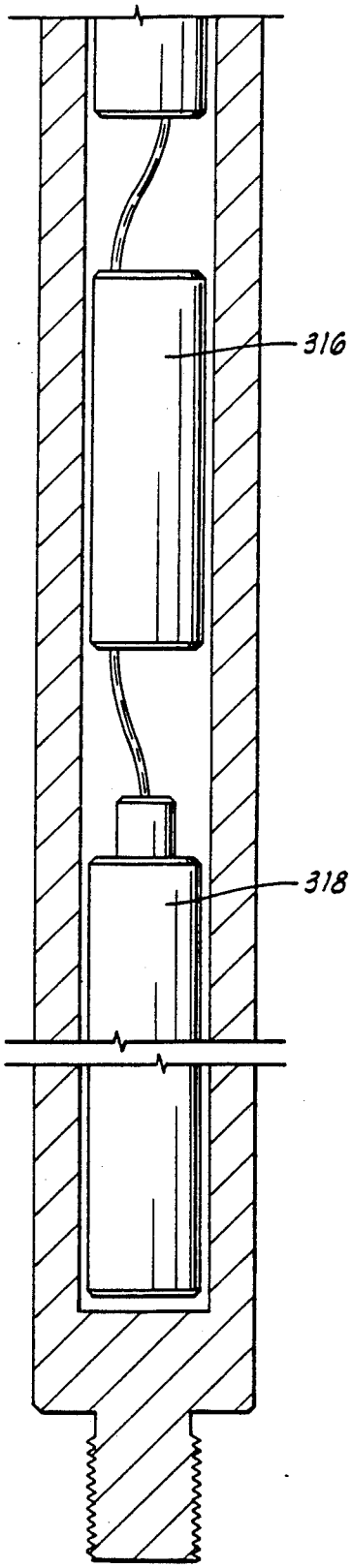

The Embodiment of FIGS. 12A–12B

FIGS. 12A–12B disclose an embodiment rather similar to that of FIGS. 11A–11B, except that it is adapted for use with a self-contained electronic timer means which does not rely on a signal transmitted from the surface.

In this embodiment an electronic timer housing section 312 is connected to the blocking means housing section 138 at threaded connection 314. An electronic timer 316 powered by batteries 318 controls a solenoid 320 having a plunger 322 connected to a sleeve valve 324 of the blocking valve means 188.

The electronic timer means 316 provides a means for providing a time delay prior to a time at which the blocking valve 188 opens to permit the sample valve means 166 to slide downward relative to body 122 thus forcing hydraulic fluid through the restricted orifice 160.

All of the various embodiments of the present invention provide a very reliable design for a fluid sampling apparatus, regardless of which of the activation systems is utilized. This is so because all of the tools involve the use of tremendous hydraulically induced forces to drive the sample valve mechanism thus insuring the opening and closing of the sample valve mechanism. The fact that the operating forces are so high greatly reduces the susceptibility of the tool to operational problems associated with sand or other debris in the sample valve means that is in contact with the well bore fluids.

Another significant advantage of each of the systems described above is that the activation mechanisms are completely removed from well bore fluid and contamination which might affect their performance or reliability.

With regard to those embodiments utilizing the hydraulic timer mechanism, that hydraulic timer mechanism offers the advantage of not being adversely affected by elevated temperatures which would disable most electronic devices.

An important basic concept which has been utilized in all versions of this tool is the use of a clean oil system to control tremendous forces created by a hydraulic area which is driven by a differential pressure between well bore hydrostatic pressure and the atmospheric pressure inside an air chamber. The various methods of activation described above all use this concept because all of the methods eventually open either the rupture disk or the initiator valve to allow high pressure oil to meter from the oil chamber 150 into the air chamber 152.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts may be made by those skilled in the art, which changes are encompassed within the scope and spirit of the present invention as defined by the appended claims.

What is claimed is:

1. A fluid sampling apparatus, comprising:

a body having a first chamber, a second chamber, a third chamber and a sample port defined therein, said sample port being communicated with an outside zone outside of said body;

impedance means, disposed in said body between said second and third chambers, for impeding fluid flow from said second chamber to said third chamber;

sample valve means, disposed in said body between said sample port and said first chamber, for being moved relative to said body in response to outside pressure from said outside zone acting on said sample valve means, and for communicating said sample port with said first chamber only after a predetermined first time delay after said outside pressure begins moving said sample valve means; and selective blocking means, disposed in said body between said second and third chambers, for initially isolating said second chamber from said third chamber to hydraulically block said sample valve means against movement in response to said outside pressure.

2. The apparatus of claim 1, wherein:

said selective blocking means is further characterized as a means for communicating said second and third chambers when a pressure differential between said outside zone and said third chamber reaches a predetermined level so that said outside pressure can move said sample valve means.

3. The apparatus of claim 2, wherein:

said selective blocking means is a rupture disk.

4. The apparatus of claim 1, wherein:

said selective blocking means is further characterized as a means for communicating said second and third chambers independently of a value of a pressure differential between said outside zone and said third chamber so that said outside pressure can move said sample valve means.

5. The apparatus of claim 4, wherein said selective blocking means comprises:

a blocking valve having a closed position wherein said second and third chambers are isolated from each other, and an open position wherein said second and third chambers are communicated with each other;

enabling means for moving said blocking valve from its said closed position to its said open position and for thereby enabling said sample valve means to be moved by said outside pressure; and timer means for providing a second time delay prior to a time at which said enabling means moves said blocking valve to its said open position.

6. The apparatus of claim 4, wherein:

said selective blocking means includes timer means for providing a second time delay prior to a time at which said selective blocking means communicates said second and third chambers.

7. The apparatus of claim 6, wherein:

said timer means is a hydraulic timer means having a fluid flow restriction and a spring biased piston means for pushing a predetermined volume of fluid through said fluid flow restriction.

8. The apparatus of claim 7, wherein:

said spring biased piston is biased by a compressed gas spring.

9. The apparatus of claim 7, further comprising:

mechanical initiating means for starting said hydraulic timer means prior to placement of said apparatus in a well.

10. The apparatus of claim 7, further comprising:

pressure responsive switching means for starting said hydraulic timer means in response to an increase in said outside pressure to a predetermined level.

11. The apparatus of claim 7, further comprising:

electrically powered initiating means for starting said hydraulic timer means in response to a signal transmitted from a surface location of a well in which said apparatus is located.

12. The apparatus of claim 7, further comprising:

an electronic timer means for starting said hydraulic timer means after a third time delay.

13. The apparatus of claim 6, wherein:

said timer means is an electronic timer means.

14. The apparatus of claim 4, wherein said selective blocking means comprises:

a blocking valve having a closed position wherein said second and third chambers are isolated from each other, and an open position wherein said second and third chambers are communicated with each other; and electrically powered actuating means for moving said blocking valve to its open position in response to a signal transmitted from a surface location of a well in which said apparatus is located.

15. The apparatus of claim 1, further comprising:

disabling means for disabling said sampler apparatus when said outside pressure exceeds a predetermined level.

16. The apparatus of claim 15, wherein:

said disabling means is further characterized as a means for balancing said outside pressure from said outside zone across said first chamber when said outside pressure exceeds said predetermined level.

17. The apparatus of claim 16, wherein:

said body has a pressure relief passage defined therein extending from said outside zone to said first chamber; and said disabling means includes a rupture disk disposed in said relief passage, said rupture disk being constructed to rupture when said outside pressure in said outside zone exceeds said predetermined level.

18. The apparatus of claim 15, wherein:

said disabling means is further characterized as a means for preventing trapping of a fluid sample in said first chamber at a pressure in excess of said predetermined level.

19. A fluid sampling apparatus, comprising:

a housing having a first chamber, a second chamber, and a third chamber defined therein and having a sample port defined therein, said sample port being communicated with an outside zone outside of said housing;

valve means, disposed in said housing between said sample port and said first chamber for isolating said sample port from said first chamber when said valve means is in a first position and for communicating said sample port with said first chamber when said valve means is in a second position;

impedance means, disposed in said housing between said second and third chambers, for impeding fluid flow from said second chamber to said third chamber and for providing a time delay in communicating said sample port with said first chamber after a pressure differential between said outside zone and said second chamber begins moving said actuating means; and selective closure means, disposed in said housing between said second and third chambers, for initially isolating said second chamber from said third chamber to prevent said actuating means from moving said valve means to its said second position, and for subsequently communicating said second and third chambers to permit said actuating means to move said valve means to its said second position.

20. A method of sampling a well, comprising:

(a) running a fluid sampling tool into said well to a depth at which said well is to be sampled, said fluid sampling tool including:

a housing having a first chamber, a second chamber, and a third chamber defined therein and having a sample port defined therein, said sample port being communicated with said well outside said housing;

a sample valve disposed in said housing between said sample port and said first chamber;

an actuating piston connected to said sample valve, said actuating piston having a first side communicated with said well and a second side communicated with said second chamber; and a fluid flow restriction disposed in said housing between said second and third chambers; and (b) initially preventing said actuating piston from moving said sample valve toward an open position wherein said sample port is communicated with said first chamber by isolating said second chamber from said third chamber and hydraulically blocking said actuating piston.

21. The method of claim 20, further comprising:

(c) after step (b), communicating said second and third chambers when a pressure differential between said well and said third chamber reaches a predetermined level; and (d) after step (c), moving said sample valve with said actuating piston through an open position wherein a fluid sample flows through said sample port into said first chamber, and then to a final position wherein said fluid sample is trapped in said first chamber.

22. The method of claim 21, wherein:

said step (b) is accomplished by placing a rupture disk between said second and third chambers; and said step (c) is accomplished by rupturing said rupture disk when said pressure differential reaches said predetermined level.

23. The method of claim 20, further comprising:

(c) after step (b), communicating said second and third chambers independently of a value of a pressure differential between said well and said third chamber so that said actuating piston can then move in response to pressure in said well; and (d) after step (c), moving said sample valve with said actuating piston through an open position wherein a fluid sample flows through said sample port into said first chamber, and then to a final position wherein said fluid sample is trapped in said first chamber.

24. The method of claim 23, wherein:

said step (a) is further characterized in that said fluid sampling tool has a blocking valve disposed therein between said second and third chambers;

said step (b) is accomplished by initially retaining said blocking valve in a closed position; and said step (c) is accomplished by moving said blocking valve to an open position.

25. The method of claim 24, further comprising:

(e) providing a predetermined time delay prior to step (c).

26. The method of claim 25, wherein:

said step (e) is accomplished with a hydraulic timer by pushing a predetermined volume of hydraulic fluid through a fluid flow restriction with a spring biased piston.

27. The method of claim 26, wherein:

said step (e) is further characterized in that said spring biased piston is biased by a compressed gas spring.

28. The method of claim 26, wherein:

step (e) is further characterized in that said hydraulic timer starts pushing said hydraulic fluid through said fluid flow restriction prior to beginning step (a) and finishes pushing said hydraulic fluid through said fluid flow restriction after completing step (a).

29. The method of claim 26, wherein:

step (e) is further characterized in that said hydraulic timer starts pushing said hydraulic fluid through said fluid flow restriction in response to an increase in well pressure surrounding said fluid sampling tool to a predetermined level.

30. The method of claim 26, wherein:

step (e) is further characterized in that said hydraulic timer starts pushing said hydraulic fluid through said fluid flow restriction in response to an electrical signal transmitted from a surface location of said well.

31. The method of claim 26, wherein:

step (e) is further characterized in that said hydraulic timer starts pushing said hydraulic fluid through said fluid flow restriction in response to a self-contained electronic timer disposed in said fluid sampling tool.

32. The method of claim 24, further comprising:

transmitting a signal from a surface location of said well down to said fluid sampling tool; and said step (c) is further characterized as moving said blocking valve to its said open position in response to said signal.

33. The method of claim 20, further comprising:

disabling said fluid sampling tool when fluid pressure in said well at said sample port exceeds a predetermined level.

34. The method of claim 33, wherein:

said disabling step is further characterized as balancing fluid pressure from said well across said first chamber and preventing trapping of a fluid sample in said first chamber when said fluid pressure in said well exceeds said predetermined level.

35. A downhole tool apparatus, comprising:

a body having a low pressure chamber defined therein, and having a first port defined therein communicated with an outside zone outside of said body;

a pressure responsive operating mechanism disposed in said body and having a first side communicated with said outside zone through said first port and a second side communicated with said low pressure chamber; and disabling means for disabling said apparatus when fluid pressure in said outside zone exceeds a predetermined level.

36. The apparatus of claim 35, wherein:

said disabling means is further characterized as a means for communicating fluid pressure from said outside zone to said low pressure chamber and to said second side of said operating mechanism.

37. The apparatus of claim 36, wherein:

said body has a relief passage defined therein extending from said outside zone to said low pressure chamber; and said disabling means includes a rupture disk disposed in said relief passage, said rupture disk being constructed to rupture when said fluid pressure in said outside zone exceeds said predetermined level.

38. The apparatus of claim 35, said apparatus being a fluid sampling apparatus, wherein:

said disabling means is further characterized as a means for preventing trapping of a fluid sample within said body at a pressure in excess of said predetermined level.

39. The apparatus of claim 38, wherein:

said pressure responsive operating mechanism includes a floating piston separating said low pressure chamber from said first port.

40. A fluid sampling apparatus, comprising:

a body having a first chamber, a second chamber, a third chamber, a sample port and a power port defined therein;

means, disposed in said body between said second and third chambers, for impeding fluid flow from said second chamber to said third chamber; and valve means, disposed in said body between said sample port and said first chamber for being moved relative to said body in response to pressure acting on said valve means through said power port, for communicating said sample port with said first chamber only after a predetermined time delay after said pressure begins moving said valve means.

41. The apparatus of claim 40, further comprising:

seal means, between said valve means and said body for isolating said first chamber from said second chamber and from both said sample port and said power port after said first chamber is filled with sample fluid from said sample port.

42. The apparatus of claim 40, wherein said valve means comprises:

first closure means for maintaining said sample port sealed from said first chamber as said valve means moves relative to said sample port during said predetermined time delay;

open means, connected to said first closure means, for providing a fluid conducting passageway between said sample port and said first chamber after said predetermined time delay; and second closure means, connected to said open means, for sealing said first chamber from said second chamber and from said sample port after said open means has moved past said sample port to a final closed position of said valve means wherein a fluid sample is sealed in said first chamber.

* * * * *